US011205380B2

(12) United States Patent
Park et al.

(10) Patent No.: US 11,205,380 B2
(45) Date of Patent: Dec. 21, 2021

(54) PIXEL THAT COMPENSATES FOR A THRESHOLD VOLTAGE OF A DRIVING TRANSISTOR USING A POWER SOURCE VOLTAGE AND DISPLAY DEVICE HAVING THE SAME

(71) Applicant: SAMSUNG DISPLAY CO., LTD., Yongin-si (KR)

(72) Inventors: Jun Hyun Park, Yongin-si (KR); Bon Yong Koo, Yongin-si (KR); Yu Jin Lee, Yongin-si (KR); Kyung Hoon Chung, Yongin-si (KR); Chong Chul Chai, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/852,630

(22) Filed: Apr. 20, 2020

(65) Prior Publication Data

US 2021/0027701 A1 Jan. 28, 2021

(30) Foreign Application Priority Data

Jul. 22, 2019 (KR) ..... 10-2019-0088437

(51) Int. Cl.
*G09G 3/325* (2016.01)
*G09G 3/36* (2006.01)
*G09G 3/3291* (2016.01)

(52) U.S. Cl.
CPC ..... *G09G 3/325* (2013.01); *G09G 3/3291* (2013.01); *G09G 3/3659* (2013.01)

(58) Field of Classification Search
None
See application file for complete search history.

(56) References Cited

U.S. PATENT DOCUMENTS

| | | | | |
|---|---|---|---|---|
| 7,443,367 | B2 | 10/2008 | Numao | |
| 10,056,034 | B2 | 8/2018 | Zhu et al. | |
| 2008/0129212 | A1* | 6/2008 | Chen | G09G 3/3233 315/169.1 |
| 2016/0063921 | A1* | 3/2016 | Tsai | G09G 3/3233 345/76 |

(Continued)

FOREIGN PATENT DOCUMENTS

| | | |
|---|---|---|
| KR | 10-2013-0075429 | 7/2013 |
| KR | 10-2021-0011554 | 2/2021 |

*Primary Examiner* — Chad M Dicke
(74) *Attorney, Agent, or Firm* — F. Chau & Associates, LLC

(57) ABSTRACT

A pixel including: a light-emitting element; a first transistor including a first electrode coupled to a power source and a second electrode coupled to the light-emitting element; a first capacitor between a second and a third node; a second transistor between the third node and a data line and turned on by a scan signal; a third transistor between a first node and the second node and turned on by a first control signal; a fourth transistor between the power source and the third node and turned on by a second control signal; a fifth transistor between the power source and the first electrode of the first transistor and turned on by an emission control signal; a sixth transistor between the second node and the light-emitting element and turned on by a previous emission control signal; and a second capacitor between the power source and the first node.

19 Claims, 15 Drawing Sheets

(56) References Cited

U.S. PATENT DOCUMENTS

| | | | | |
|---|---|---|---|---|
| 2017/0103706 | A1* | 4/2017 | Yang | G09G 3/3233 |
| 2018/0374419 | A1 | 12/2018 | Chen et al. | |
| 2019/0279570 | A1* | 9/2019 | Cheng | G09G 3/3258 |
| 2020/0126478 | A1* | 4/2020 | Lee | G09G 3/325 |
| 2021/0027702 | A1 | 1/2021 | Park et al. | |

* cited by examiner

PIXEL THAT COMPENSATES FOR A THRESHOLD VOLTAGE OF A DRIVING TRANSISTOR USING A POWER SOURCE VOLTAGE AND DISPLAY DEVICE HAVING THE SAME

CROSS-REFERENCE TO RELATED APPLICATION

The present application claims priority under 35 U.S.C. § 119 to Korean patent application number 10-2019-0088437 filed on Jul. 22, 2019, the disclosure of which is incorporated by reference herein in its entirety.

1. TECHNICAL FIELD

Exemplary embodiments of the present invention relate to a display device, and more particularly, to a pixel and a display device including the same.

2. DISCUSSION OF RELATED ART

A display device is an output device for the presentation of information in visual form. In general, a display device includes a plurality of pixels, and each of the pixels emits light based on a data signal supplied to a driving transistor.

A method for driving a display device at a low frequency (e.g., 1 Hz) may be used to minimize power consumption. However, when driving a display device at a low-frequency, a displayed image may flicker. To prevent image flicker, techniques for minimizing the leakage of a data signal stored in a pixel may be employed.

In addition to low-frequency driving, a display device may be driven at a high frequency (e.g., 120 Hz) to realize a high-resolution image or a stereoscopic image. However, to guarantee image quality higher than a certain level when the display device is driven at a high speed, a sufficient time to compensate for the threshold voltage of a driving transistor should be secured.

SUMMARY

An exemplary embodiment of the present invention provides a pixel including: a light-emitting element; a first transistor configured to control a driving current, the first transistor including a first electrode electrically coupled to a first power source and a second electrode electrically coupled to the light-emitting element; a first capacitor coupled between a second node and a third node, wherein the second node is connected to the second electrode of the first transistor; a second transistor coupled between the third node and a data line and configured to be turned on in response to a scan signal; a third transistor coupled between a first node and the second node and configured to be turned on in response to a first control signal, wherein the first node is connected to a gate electrode of the first transistor; a fourth transistor coupled between the first power source and the third node and configured to be turned on in response to a second control signal; a fifth transistor coupled between the first power source and the first electrode of the first transistor and configured to be turned on in response to an emission control signal; a sixth transistor coupled between the second node and the light-emitting element and configured to be turned on in response to a previous emission control signal; and a second capacitor coupled between the first power source and the first node.

When the third transistor and the fourth transistor are turned on, the second transistor and the sixth transistor may be turned off.

The pixel may further include: a seventh transistor coupled between the light-emitting element and an initialization power source and configured to be turned on in response to a third control signal.

The first transistor, the second transistor, the fourth transistor, the fifth transistor and the sixth transistor may be P-channel metal oxide semiconductor (PMOS) transistors, and the third transistor and the seventh transistor may be N-channel metal oxide semiconductor (NMOS) transistors.

The first control signal and the third control signal may be identical signals supplied through an identical control line.

The second control signal may be identical to the emission control signal.

A voltage of the initialization power source may be supplied to the light-emitting element in a first period, the voltage of the initialization power source may be supplied to the first node in a second period, the first transistor may be diode-coupled based on a voltage of the first power source in a third period, and the second transistor may be turned on such that a data signal is supplied to the third node through the data line in a fourth period.

The third transistor may maintain a turn-on state during the first, second, third and fourth periods in response to the first control signal.

In the first period and the third period, the fifth transistor may be turned on and the sixth transistor may be turned off; and in the second period, the fifth transistor may be turned off and the sixth transistor may be turned on.

The emission control signal may be shifted by k horizontal periods from the previous emission control signal, where k is an integer greater than or equal to 3.

In the first period, the sixth transistor may be turned off: and in the second period, the third transistor, the sixth transistor, and the seventh transistor may be turned on.

The first transistor, the second transistor, the fifth transistor, and the sixth transistor may be PMOS transistors, and the third transistor, the fourth transistor, and the seventh transistor may be NMOS transistors.

The first control signal and the third control signal may be identical signals supplied through an identical control line, and the second control signal may be shifted by k horizontal periods from the first control signal, where k is an integer greater than or equal to 3.

The emission control signal may be shifted by k horizontal periods from the previous emission control signal, where k is an integer greater titan or equal to 3.

The first transistor, the second transistor, the fourth transistor, the fifth transistor, the sixth transistor and the seventh transistor may be PMOS transistors, and the third transistor may be an NMOS transistor.

The second control signal and the third control signal may be identical signals supplied through an identical control line.

The pixel may further include, an eighth transistor coupled between the second node and the first capacitor and configured to be turned on in response to the first control signal.

The pixel may further include: an eighth transistor coupled between the second node and the first capacitor and configured to be turned on in response to the scan signal.

An exemplary embodiment of the present invention provides a display device including: a display panel including a plurality of pixels; a first scan driver configured to supply a scan signal to the pixels through a plurality of scan lines;

a second scan driver configured to supply a control signal to the pixels through a plurality of control lines; an emission driver configured to supply an emission control signal to the pixels through a plurality of emission control lines; and a data driver configured to supply a data voltage to the display panel through a plurality of data lines, wherein at least one of the pixels includes: a light-emitting element; a first transistor configured to control a driving current, the first transistor including a first electrode electrically coupled to a first power source and a second electrode electrically coupled to the light-emitting element; a first capacitor coupled between a second node and a third node, wherein the second node is connected to the second electrode of the first transistor; a second transistor coupled between the third node and the data line and configured to be turned on by the scan signal; a third transistor coupled between a first node and the second node and configured to be turned on by the control signal, wherein the first node is connected to a gate electrode of the first transistor; a fourth transistor coupled between the first power source and the third node and configured to be turned on by the emission control signal; a fifth transistor coupled between the first power source and the first electrode of the first transistor and configured to be turned on by the emission control signal; a sixth transistor coupled between the second node and the light-emitting element and configured to be turned on by a previous emission control signal: a second capacitor coupled between the first power source and the first node; and a seventh transistor coupled between the light-emitting element and an initialization power source and configured to be turned on by the control signal.

An exemplary embodiment of the present invention provides a pixel including: a light-emitting element; a first transistor including a first electrode electrically coupled to a first power source and a second electrode electrically coupled to the light-emitting element; a second transistor coupled to a data line and configured to be turned on by a scan signal; a first capacitor coupled between the second electrode of the first transistor and the second transistor, a third transistor coupled between a gate electrode of the first transistor and the first capacitor and configured to be turned on by a first control signal; a fourth transistor coupled between the first power source and the first capacitor; a fifth transistor coupled between the first power source and the first electrode of the first transistor and configured to be turned on in response to an emission control signal, wherein a gate electrode of the fifth transistor is connected to a gate electrode of the fourth transistor; a sixth transistor coupled between the first capacitor and the light-emitting element and configured to be turned on by a previous emission control signal; and a second capacitor coupled between the first power source and the gate electrode of the first transistor.

DETAILED DESCRIPTION OF THE EMBODIMENTS

Figure 1:
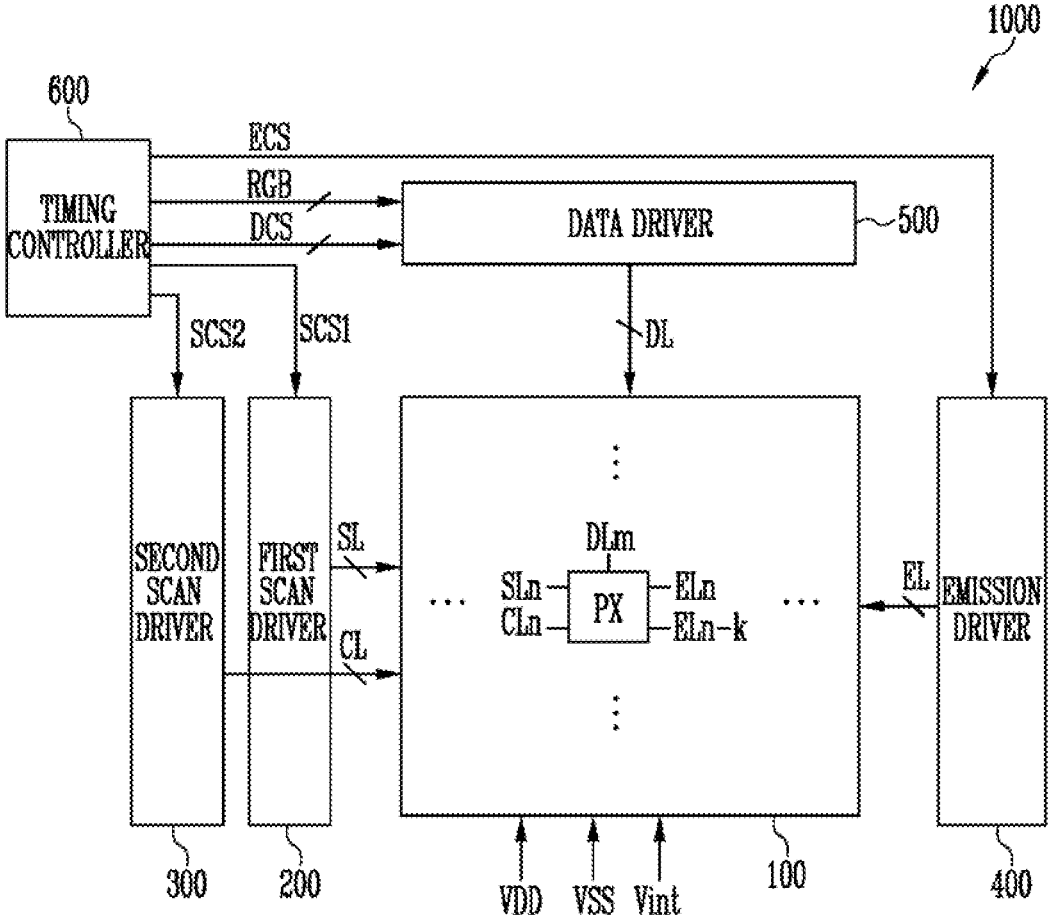
FIG. 1 is a block diagram illustrating a display device according to exemplary embodiments of the present invention.

Hereinafter, exemplary embodiments of the present invention will be described in detail with reference to the accompanying drawings. In the drawings, the same or similar elements may be denoted by the same reference numerals, and thus, a repeated description of the same or similar elements may be omitted.

FIG. 1 is a block diagram that shows a display device according to exemplary embodiments of the present invention.

Referring to FIG. 1, the display device 1000 may include a display panel 100, a first scan driver 200, a second scan driver 300, an emission driver 400, a data driver 500, and a timing controller 600.

In an exemplary embodiment of the present invention, the display device 1000 may further include a power supply for supplying the voltage of a first power source VDD, the voltage of a second power source VSS, and the voltage of a third power source (or an initialization power source Vint) to the display panel 100. The power supply may supply the first scan driver 200, the second scan driver 300, and/or the emission driver 400 with the voltage of a low power source or a high power source to determine the gate-on level or the gate-off level of a scan signal, a control signal, and/or an emission control signal. The low power source may have a voltage level that is lower than that of the high power source. However, this is merely an example, and at least one of the voltage of the first power source VDD, the voltage of the second power source VSS, the voltage of the initialization power source Vint, the voltage of the low power source, and the voltage of the high power source may be supplied from the timing controller 600 or the data driver 500.

According to an exemplary embodiment of the present invention, the first power source VDD and the second power source VSS may generate voltages for driving a light-emitting element. In an exemplary embodiment of the present invention, the voltage of the second power source VSS may be lower than that of the first power source VDD. For example, the voltage of the first power source VDD may be a positive voltage, and the voltage of the second power source VSS may be a negative voltage.

The initialization power source Vint may be used to initialize a pixel PX. For example, a driving transistor and/or a light-emitting element included in the pixel PX may be initialized by the voltage of the initialization power source Vint. The voltage of the initialization power source Vint may be a negative voltage.

The display panel 100 may include a plurality of scan lines SL, a plurality of control lines CL, a plurality of emission control lines EL, and a plurality of data lines DL, and may include a plurality of pixels PX coupled to the scan lines SL, the control lines CL, the emission control lines EL, and the data lines DL. In an exemplary embodiment of the present invention, the pixel PX disposed in the n-th pixel row and the m-th pixel column may be coupled to the scan line SLn corresponding to the n-th pixel row, the control line CLn corresponding to the n-th pixel row, the emission control line ELn corresponding to the n-th pixel row, the emission control line ELn-k corresponding to the (n−k)-th pixel row, and the data line DLm corresponding to the m-th pixel column (where n and m are natural numbers and k is a natural number that is equal to or less than 10).

The timing controller 600 may generate a first driving control signal SCS1, a second driving control signal SCS2, a third driving control signal ECS, and a fourth driving control signal DCS in response to synchronization signals supplied from the outside. The first driving control signal SCS1 may be supplied to the first scan driver 200, the second driving control signal SCS2 may be supplied to the second scan driver 300, the third driving control signal ECS may be supplied to the emission driver 400, and the fourth driving control signal DCS may be supplied to the data driver 500. In addition, the timing controller 600 may rearrange input image data, supplied from the outside, to form image data RGB, and may supply the image data RGB to the data driver 500.

The first driving control signal SCS1 may include a first scan start pulse and clock signals. The first scan start pulse may control the first timing of a scan signal. The clock signals of the first driving control signal SCS1 may be used to shift rite first scan start pulse.

The second driving control signal SCS2 may include a second scan start pulse (e.g., the start pulse of a control signal) and clock signals. The second scan start pulse may control the first timing of a control signal. The clock signals of the second driving control signal SCS2 may be used to shift the second scan start pulse. In an exemplary embodiment of the present invention, the control signal may be a scan signal (e.g., a second scan signal) that is different from the scan signal (e.g., the first scan signal) output from the first scan driver 200.

The third driving control signal ECS may include an emission control start pulse and clock signals. The emission control start pulse may control the first timing of an emission control signal. The clock signals of the third driving control signal ECS may be used to shift the emission control start pulse.

The fourth driving control signal DCS may include a source start pulse and clock signals. The source start pulse controls the time at which sampling of data is started. The clock signals of the fourth driving control signal DCS may be used to control a sampling operation.

The first scan driver 200 may receive the first driving control signal SCS1 from the timing controller 600 and supply a scan signal to the scan lines SL based on the first driving control signal SCS1. For example, the first scan driver 200 may sequentially supply a scan signal (e.g., a first scan signal) to the scan lines SL (e.g., the first scan lines) at intervals of one horizontal period 1H. When the scan signal is sequentially supplied, pixels PX are selected in units of horizontal lines (or in units of pixel rows), whereby a data signal may be supplied to the pixels PX. According to an exemplary embodiment of the present invention, the scan signal may have a pulse width that is equal to or greater than one horizontal period 1H.

The scan signal may be set to a gate-on level (e.g., a low voltage). The transistor included in a pixel PX and configured to receive the scan signal may be set to a turn-on state when the scan signal of the gate-on level is supplied.

The second scan driver 300 may receive the second driving control signal SCS2 from the timing controller 600 and supply a control signal (e.g., a second scan signal) to the control lines CL (e.g., the second scan lines) based on the second driving control signal SCS2. For example, the second scan driver 300 may sequentially supply the control signal to the control lines CL at intervals of a period longer than one horizontal period 1H (e.g., at intervals of two horizontal periods 2H). When the control signal is supplied from the second scan driver 300, the pixels PX may perform an operation to compensate for a threshold voltage and/or perform an initialization operation.

In an exemplary embodiment of the present invention, the second scan driver 300 may simultaneously supply the control signal to consecutive pixel rows. For example, the second scan driver 300 may simultaneously supply the same control signal to the n-th control line CLn and the (n+1)-th control line CLn+1. In other words, the second scan driver 300 may shift and supply a control signal in units of two or more control lines, and the consecutive pixel rows corresponding to the control lines may share the same control signal.

In this case, the number of stages that are included in the second scan driver 300 to shift and output a control signal may be less than the number of stages included in the first scan driver 200.

However, this is merely an example, and the second scan driver 300 may supply the pixel rows with a control signal at a different timing.

The control signal may be set to a gate-on level (e.g., a low voltage). The transistor included in a pixel PX and configured to receive the control signal may be set to a turn-on state when the control signal of the gate-on level is supplied.

The emission driver 400 may receive the third driving control signal ECS from the timing controller 600 and supply an emission control signal to the emission control lines EL based on the third driving control signal ECS. For example, the emission driver 400 may sequentially supply an emission control signal to the emission control lines EL.

In an exemplary embodiment of the present invention, the emission driver 400 may simultaneously supply the emission control signal to consecutive pixel rows. For example, the emission driver 400 may simultaneously supply the same control signal to the n-th emission control line ELn and the (n+1)-th emission control line ELn+1. In other words, the emission driver 400 may shift and supply an emission control signal in units of two or more emission control lines, and the consecutive pixel rows corresponding to the emission control lines may share the same emission control signal.

In this case, the number of stages that are included in the emission driver 400 to shift and output an emission control signal may be less than the number of stages included in the first scan driver 200.

The emission control signal may be set to a gate-on level (e.g., a low voltage). When the emission control signal of the gate-on level is supplied, the transistor included in a pixel PX and configured to receive the emission control signal may be turned on. Otherwise, the transistor may be set to a turn-off state.

The emission control signal is used to control the emission time of pixels PX. To accomplish this, the pulse width of the emission control signal may be set greater than the pulse width of a scan signal. In an exemplary embodiment of the present invention, during one frame period, the emission control signal may have a plurality of periods in which the emission control signal is set to a gate-off level (e.g., high voltage).

Each of the first scan driver 200, the second scan driver 300, and the emission driver 400 may be mounted on a substrate through a thin-film fabrication process. In addition, each of the first scan driver 200 and the second scan driver 300 may be placed on the opposite sides of the display panel 100. The emission driver 400 may also be placed on the opposite sides of the display panel 100.

The data driver 500 may receive the fourth driving control signal DCS and the image data RGB from the timing controller 600. The data driver 500 may supply a data signal to the data lines DL in response to the fourth driving control signal DCS. The data signal supplied to the data lines DL may be supplied to the pixels PX that are selected based on the scan signal. To accomplish this, the data driver 500 may supply the data signal to the data lines DL to be synchronized with the scan signal.

Figure 2A:
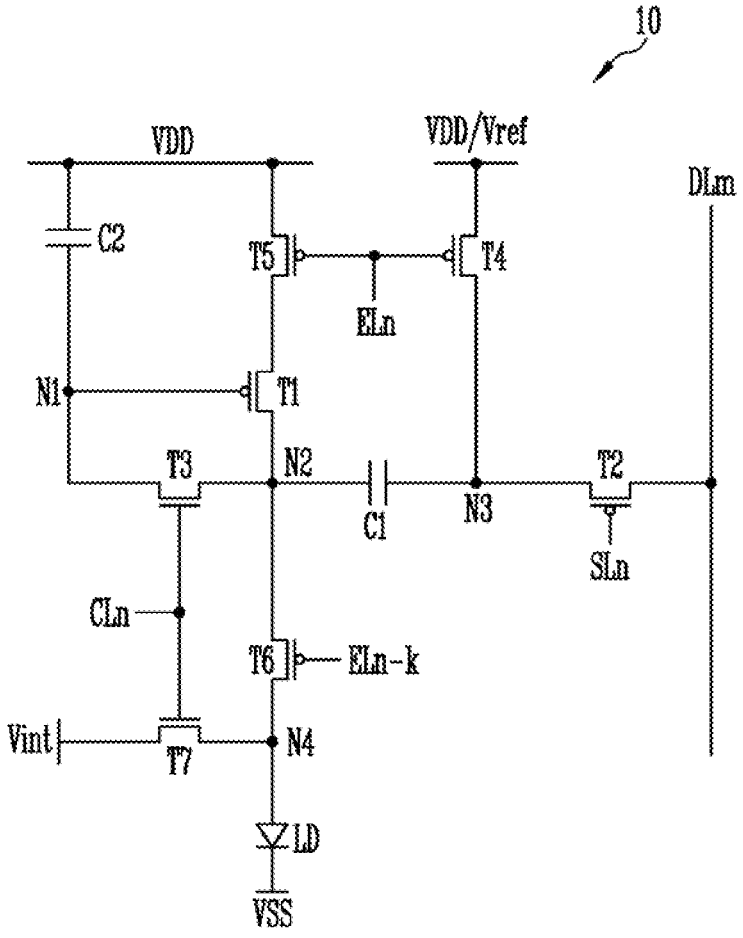
FIG. 2A is a circuit diagram illustrating a pixel according to exemplary embodiments of the present invention.

FIG. 2A is a circuit diagram that shows a pixel according to exemplary embodiments of the present invention.

For the convenience of description, FIG. 2A illustrates the pixel 10 disposed in the n-th horizontal line (or the n-th pixel row) and coupled to the m-th data line DLm.

According to an exemplary embodiment of the present invention, a previous emission control line ELn-k may supply an emission control signal that is the same as the emission control signal supplied to the emission control line coupled to the (n−k)-th pixel row.

Referring to FIG. 2A, the pixel 10 may include a light-emitting element LD, first, second, third, fourth, fifth, sixth and seventh transistors T1, T2, T3, T4, T5, T6 and 17, a first capacitor C1, and a second capacitor C2.

The first electrode of the light-emitting element LD may be electrically coupled to the second electrode (e.g., the drain electrode) of the first transistor T1, and the second electrode of the light-emitting element LD may be coupled to a second power source VSS. For example, the first electrode of the light-emitting element LD may be coupled to a fourth node N4 to which one electrode of the sixth transistor T6 and one electrode of the seventh transistor T7 are coupled.

The light-emitting element LD may generate light having predetermined luminance in response to the amount of current (e.g., a driving current) supplied from the first transistor T1. In an exemplary embodiment of the present invention, the light-emitting element LD may be an organic light-emitting diode including an organic emission layer. In this case, the first electrode of the light-emitting element LD may be an anode electrode, and the second electrode of the light-emitting element LD may be a cathode electrode. Conversely, the first electrode of the light-emitting element LD may be a cathode electrode, and the second electrode of the light-emitting element LD may be an anode electrode.

In another exemplary embodiment of the present invention, the light-emitting element LD may be an inorganic light-emitting element formed of an inorganic material. Alternatively, the light-emitting element LD may be formed such that a plurality of inorganic light-emitting elements are coupled in parallel and/or in serial between the second power source VSS and the second electrode of the first transistor T1.

The first transistor T1 may be electrically coupled between a first power source VDD and the first electrode of the light-emitting element LD. The first transistor T1 may generate a driving current and supply lire driving current to the light-emitting element LD. The gate electrode of the first transistor T1 may be coupled to a first node N1. The first transistor T1 functions as the driving transistor of the pixel 10. The first transistor T1 may control the amount of current flowing from the first power source VDD to the second power source VSS via the light-emitting element LD in response to the voltage applied to the first node N1.

The first capacitor C1 may be coupled between a second node N2, corresponding to the second electrode of the first transistor T1, and a third node N3. The first capacitor C1 may store the voltage difference between the second node N2 and the third node N3.

The second capacitor C2 may be coupled between the first power source VDD and the first node N1. The second capacitor C2 may store the voltage difference between the first power source VDD and the first node N1.

When the data signal of the pixel 10 is written, the first node N1 and the second node N2 may have voltages based on the ratio between the capacitance of the first capacitor C1 and the capacitance of the second capacitor C2 through charge sharing therebetween.

The second transistor T2 may be coupled between the data line DLm and the third node N3. The second transistor T2 may include a gate electrode configured to receive a scan signal. For example, the gate electrode of the second transistor T2 may be coupled to the scan line SLn (in other words, the n-th scan line). The second transistor T2 is turned on when the scan signal is supplied to the scan line SLn, thereby electrically coupling the data line DLm to the third node N3. Accordingly, a data voltage (or a data signal) may be transmitted to the third node N3 from the data line DLm.

The third transistor T3 may be coupled between the first node N1, corresponding to the gale electrode of the first transistor T1, and the second node N2 (e.g., the drain electrode of the first transistor T1). The third transistor T3 may include a gate electrode configured to receive a first control signal. For example, the gate electrode of the third transistor T3 may be coupled to a control line CLn (in other words, the n-th control line). The third transistor T3 is turned on when a first control signal is supplied to the control line CLn, thereby electrically coupling the first node N1 to the second node N2. When the third transistor T3 is turned on, the voltage of an initialization power source Vint is supplied to the first node N1 or the first transistor T1 may be diode-coupled. When the first transistor T1 is diode-coupled, the threshold voltage of the first transistor T1 may be compensated for.

Accordingly, the first transistor T1 may generate a driving current based on a data signal and the capacitance of the first and second capacitors C1 and C2, as illustrated in the following Equation (1):

$$Id=k[a(Vdd-Vdata)]^2 a=CC2/(CC1+CC2) \quad (1)$$

Here, Id may denote a driving current, k may denote the characteristics of the first transistor T1, Vdd may denote the voltage of the first power source VDD, Vdata may denote the data signal. CC1 may denote the capacitance of the first capacitor C1, and CC2 may denote the capacitance of the second capacitor C2. The light-emitting element LD may emit light with a luminance corresponding to the driving current Id.

The signal line coupled to the gate electrode of the third transistor T3 and the signal supplied to the gate electrode of the third transistor T3 are described as the control line CLn and the first control signal, respectively, in FIG. 2A for the convenience of description. However, the control line CLn may be a scan line that is different front the scan line SLn. In addition, the first control signal may be a scan signal that is different front the scan signal supplied to the scan line SLn.

The fourth transistor T4 may be coupled between the first power source VDD and the third node N3. The fourth transistor T4 may include a gate electrode configured to receive a second control signal.

In an exemplary embodiment of the present invention, the gate electrode of the fourth transistor T4 may be coupled to an emission control line ELn (in other words, the n-th emission control line). In this case, the second control signal may be an emission control signal. The fourth transistor T4 is turned on when the emission control signal is supplied to the emission control line ELn. In this case, the voltage of the first power source VDD is supplied to the third node N3 via the fourth transistor 14. Accordingly, the voltage of the third node N3 may be initialized to the voltage of the first power source VDD.

In an exemplary embodiment of the present invention, the fourth transistor 14 may be coupled between a reference power source Vref, which is different from the first power source VDD, and the third node N3. In this case, when the fourth transistor T4 is turned on, the voltage of the third node N3 may be initialized to the voltage of the reference power source Vref.

In addition, while the threshold voltage of the first transistor T1 is compensated for, the fourth transistor T4 may be turned on. Accordingly, the voltage of the first power source VDD or the reference power source Vref (in other words, a direct current (DC) voltage) may be used to compensate for the threshold voltage of the first transistor T1. Accordingly, the on-bias variation of the first transistor T1, which is generated due to the difference between the grayscales of adjacent frames and/or adjacent pixel rows, may be removed or not noticed.

The fifth transistor T5 may be coupled between the first power source VDD and the first electrode of the first transistor T1. The first electrode of the first transistor T1 may be a source electrode. The fifth transistor T5 may include a gate electrode configured to receive the emission control signal. For example, the gate electrode of the fifth transistor T5 may be coupled to the emission control line ELn. The fifth transistor T5 is turned on when the emission control signal is supplied, thereby coupling the first electrode of the first transistor T1 to the first power source VDD.

The sixth transistor T6 may be coupled between the second node N2, corresponding to the second electrode of the first transistor T1, and the light-emitting element LD. The sixth transistor T6 may include a gate electrode configured to receive a previous emission control signal. For example, the gate electrode of the sixth transistor T6 may be coupled to the previous emission control line ELn-k (e.g., the (n−k)-th emission control line).

For example, the previous emission control line ELn-k may be a line branching from the (n−3)-th emission control line ELn−3. In this case, each of the threshold voltage compensation period and the initialization period may correspond to about three horizontal periods 3H. Alternatively, the previous emission control line ELn-k may be the (n−6)-th emission control line ELn−6. In this case, each of the threshold voltage compensation period and the initialization period may correspond to about six horizontal periods 6H. However, these are merely examples, and the previous emission control line is not limited thereto. For example, the previous emission control line may be determined depending on the time required to compensate for the threshold voltage, the number of pixel rows simultaneously controlled, the resolution, the length of one horizontal period 1H, and the like.

The sixth transistor T6 is turned on when the emission control signal is supplied to the previous emission control line ELn-k, thereby electrically coupling the second node N2 to the fourth node N4.

When both of the fifth transistor T5 and the sixth transistor T6 are turned on, the light-emitting element LD may emit light with a luminance corresponding to the voltage of the first node N1. In an exemplary embodiment of the present invention, when the fifth transistor T5 is turned on and when the sixth transistor T6 is turned off, the threshold voltage of the first transistor T1 may be compensated for.

The seventh transistor T7 may be coupled between the light-emitting element LD and the initialization power source Vint. The seventh transistor T7 may include a gate electrode configured to receive a third control signal.

In an exemplary embodiment of the present invention, the gate electrode of the seventh transistor T7 may be coupled to the control line CLn. The seventh transistor T7 and the third transistor T3 may be the same type of transistors. In addition, the first control signal and the third control signal may be the same signal supplied through the same control line CLn.

The seventh transistor T7 is turned on when the control signal (e.g., the third control signal) is supplied to the control line CLn, thereby supplying the voltage of the initialization power source Vint to the fourth node N4. Accordingly, the voltage of the fourth node N4 may be initialized to the voltage of the initialization power source Vint.

The period during which the second transistor T2 is turned on and the period during which the fourth and fifth transistors T4 and T5 are turned on do not overlap each other. For example, when the third to fifth transistors T3 to T5 are turned on, the threshold voltage of the first transistor T1 is compensated for, and when the second and third transistors T2 and T3 are turned on, data may be written. Accordingly, the threshold voltage compensation period and the data-writing period may be separate from each other.

Figure 2B:
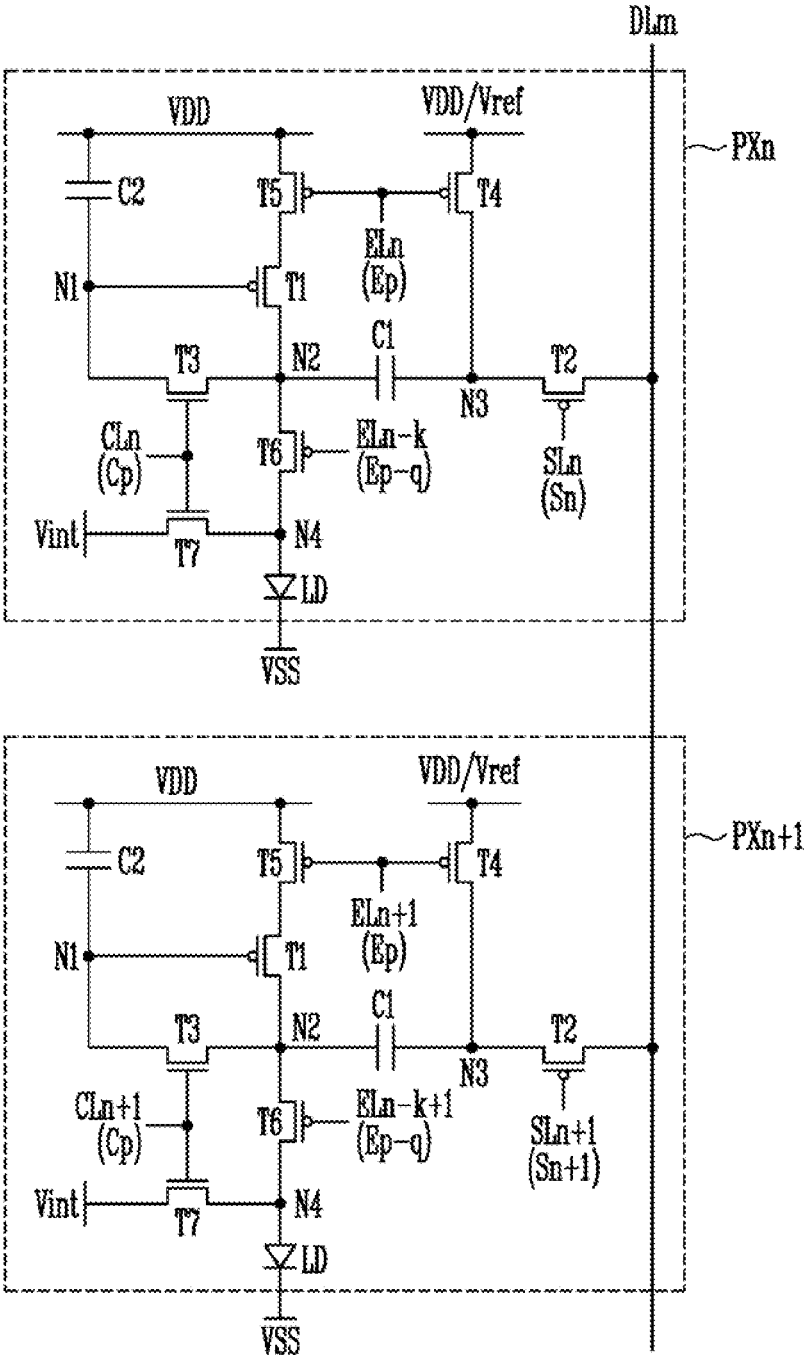
FIG. 2B is a circuit diagram for explaining an example of a coupling of the pixels of FIG. 2A.

In an exemplary embodiment of the present invention, the first transistor T1, which is a driving transistor, may be a P-channel metal oxide semiconductor (PMOS) transistor, as illustrated in FIGS. 2A and 2B. In addition, the second, fourth, fifth and sixth transistors T2, T4, T5 and T6 may be PMOS transistors that are the same type as the first transistor T1. For example, the first, second, fourth, fifth and sixth transistors T1, T2, T4, T5 and T6 may be Low-Temperature Poly-Silicon (LTPS) thin-film transistors.

The third and seventh transistors T3 and T7 may be N-channel metal oxide semiconductor (NMOS) transistors. For example, the third and seventh transistors T3 and T7 may be oxide semiconductor thin-film transistors including an active layer formed of an oxide semiconductor. Because the N-type oxide semiconductor thin-film transistor has a better leakage current characteristic than the LTPS thin-film transistor, the third and seventh transistors T3 and T7, which are turned on when the threshold voltage is compensated for and/or initialization is performed, may be formed of N-type oxide semiconductor thin-film transistors.

Accordingly, the leakage current is considerably reduced in the third and seventh transistors T3 and T7, and thus, it is possible to drive pixels and display an image even when a driving frequency is lower than 30 Hz.

FIG. 2B is a circuit diagram for explaining an example of the coupling of the pixels illustrated in FIG. 2A.

Referring to FIG. 2A and FIG. 2B, the n-th pixel PXn disposed in the n-th pixel row and the (n+1)-th pixel PXn+1 disposed in the (n+1)-th pixel row may have the same pixel structure.

A description w ill be made on the assumption that both the n-th pixel PXn and the (n+1)-th pixel Pxn+1 are coupled to the m-th data line DLm.

The n-th scan signal Sn may be supplied to the n-th scan line SLn connected to the n-th pixel PXn, and the (n+1)-th scan signal Sn+1 may be supplied to the (n+1)-th scan line SLn+1 connected to (n+1)-th pixel PXn+1. The (n+1)-th scan signal Sn+1 may be a scan signal shifted (e.g., delayed) by one horizontal period 1H from the n-th scan signal Sn.

The p-th emission control signal Ep may be supplied in common to the n-th emission control line ELn connected to the n-th pixel PXn and the (n+1)-th emission control line ELn+1 connected to the (n+1)-th pixel PXn+1 (where p is a natural number). In other words, both the n-th pixel PXn and the (n+1)-th pixel may be controlled by the same emission control signal Ep. Accordingly, the number of emission control signals may be less than the number of scan signals supplied to a display panel during a single frame period.

For example, when a single emission control signal is supplied in common to two emission control lines, the number of emission control signals may be half the number of scan signals.

According to an exemplary embodiment of the present invention, the p-th emission control signal Ep may be an emission control signal shifted (e.g., delayed) by two horizontal periods 2H or more from the (p−1)-th emission control signal Ep−1.

Similarly, the (p−q)-th emission control signal Ep-q may be supplied in common to the (n−k)-th emission control line ELn-k connected to the n-th pixel PXn and the (n−k+1)-th emission control line ELn-k+1 connected to the (n+1)-th pixel PXn-H1. In addition, the p-th emission control signal Ep may be an emission control signal shifted by q*2 horizontal periods 2H or more from the (p−q)-th emission control signal Ep-q.

Figure 3A:
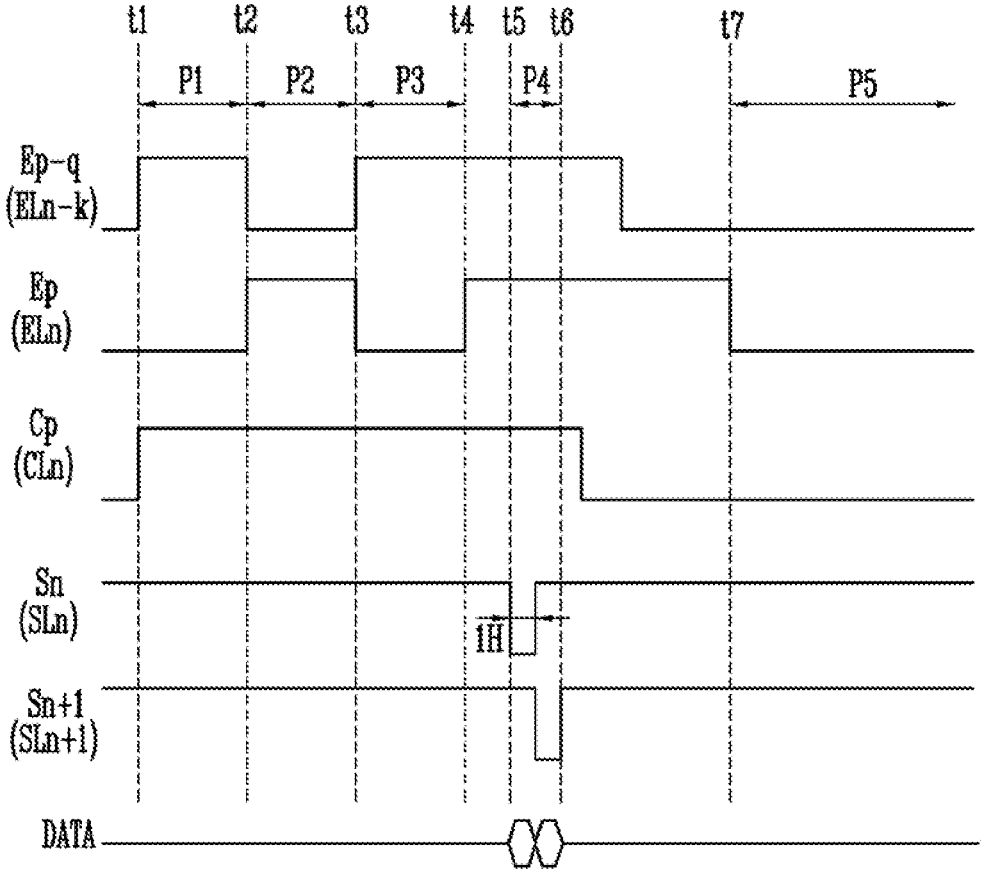
FIGS. 3A, 3B and 3C are timing diagrams for explaining examples of the operation of the pixel of FIG. 2A and FIG. 2B.
Figure 3B:
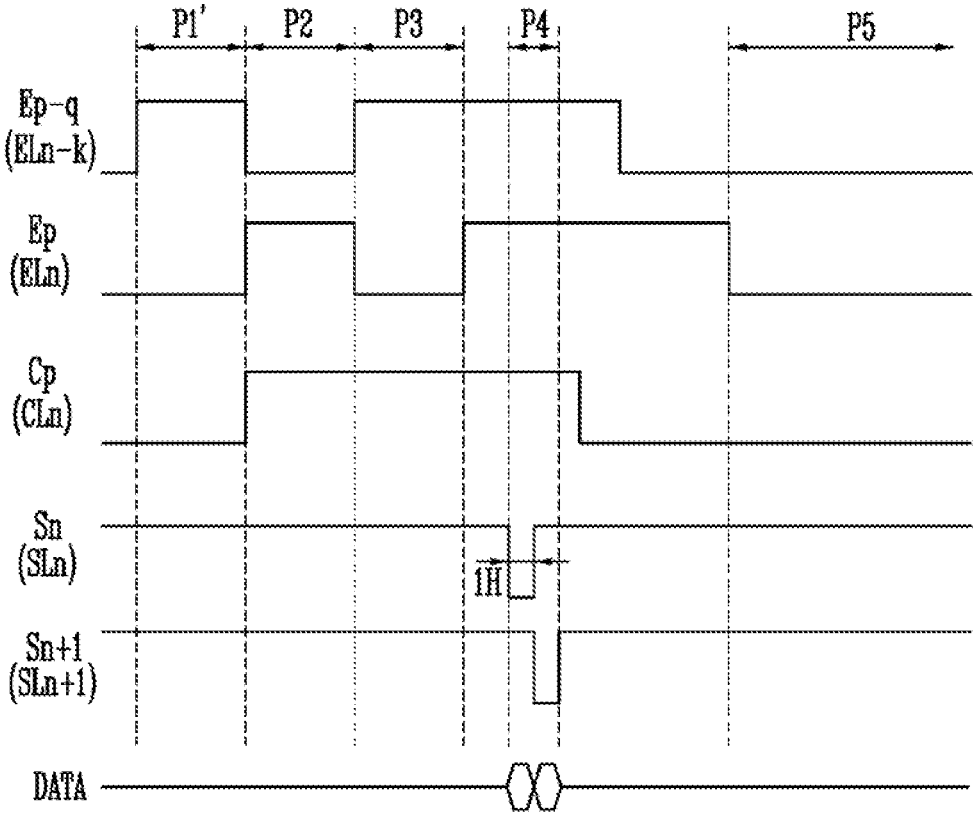
Figure 3C:
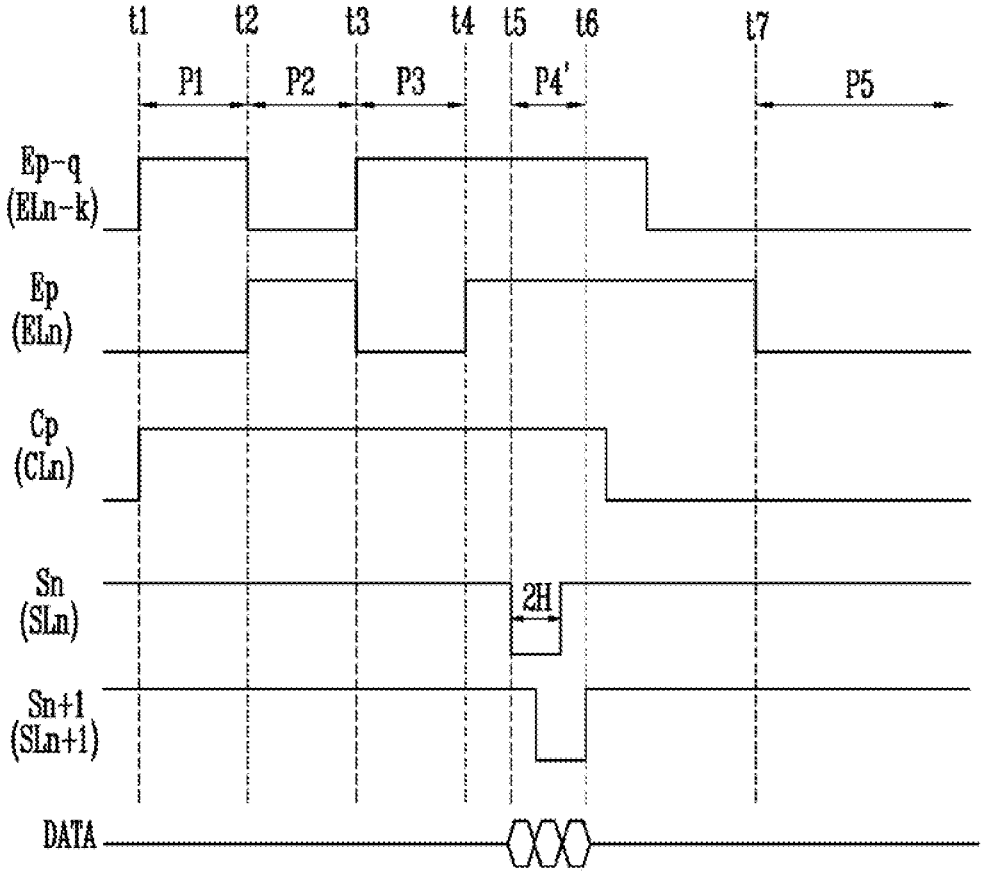

Hereinafter, a description of the present invention will be made on the assumption that n is greater than k and p is greater than q. However, the relationship between n and k and the relationship between p and q are arbitrarily set in order to conveniently describe the timing at which a signal is supplied. Therefore, even when n is equal to or less than k, it may be understood that the timing at which the emission control signal of FIGS. 3A-3C is supplied is shifted and then the emission control signal is supplied to each of the emission control lines (e.g., ELn and ELn-k).

The p-th control signal Cp may be supplied in common to the n-th control line CLn connected to the n-th pixel PXn and the (n+1)-th control line CLn+1 connected to the (n+1)-th pixel PXn+1. In other words, the n-th pixel PXn and the (n+1)-th pixel PXn+1 may be controlled by the same control signal Cp.

For example, when a single control signal is supplied in common to two control lines, the number of control signals may be half the number of scan signals.

According to an exemplary embodiment of the present invention, the p-th control signal Cp may be a control signal shifted (e.g., delayed) by two horizontal periods 2H or more front the (p−1)-th control signal Cp−1.

In other words, a scan line may be controlled for each pixel row, and an emission control line and a control line may be controlled for every preset number of consecutive pixel rows. Accordingly, the display device 1000 having a driving frequency higher than 60 Hz may be easily implemented to be driven at high speed.

However, this is merely an example, and the control signal may be sequentially supplied to pixel rows at intervals of one horizontal period 1H.

FIG. 3A is a timing diagram for explaining an example of the operation of the pixel illustrated in FIG. 2A and FIG. 2B.

Referring to FIG. 2A, FIG. 2B and FIG. 3A, the p-th emission control signal Ep may be supplied to the n-th emission control line ELn, the n-th scan signal Sn may be supplied to the n-th scan line SLn, and the p-th control signal Cp (e.g., the first control signal) may be supplied to the n-th control line CLn. In addition, the previous emission control signal Ep-q may be supplied to the previous emission control line ELn-k. Furthermore, the (n+1)-th scan signal Sn+1 is supplied to the (n+1)-th scan line Sn+1.

Hereinafter, the n-th emission control line ELn and the emission control line ELn may be interchangeably used, the p-th emission control signal Ep and the emission control signal Ep may be interchangeably used, the n-th scan line SLn and the scan line SLn may be interchangeably used, the n-th scan signal Sn and the scan signal Sn may be interchangeably used, the n-th control line CLn and the control line CLn may be interchangeably used, and the p-th control signal Cp and the control signal Cp may be interchangeably used for the convenience of description.

In addition, the emission control signal Ep, the previous emission control signal Ep-q, and the control signal Cp may be supplied in common to the n-th pixel PXn and the (n+1)-th pixel PXn+1.

In an exemplary embodiment of the present invention, the emission control signal Ep may be a scan signal shifted by about k horizontal periods kH from the previous emission control signal Ep-q. In addition, the previous emission control signal Ep-q may be the same as the emission control signal supplied to the (n−k)-th pixel row. For example, k may be set to 3 or 6.

The timing diagram of FIG. 3A shows a partial waveform during one frame period. In the period in which both the emission control signal Ep and the previous emission control signal Ep-q have a gate-on level (e.g., in the fifth period P5), the pixel 10 may emit light.

As illustrated in FIG. 3A, the emission control signal Ep may have two gate-off periods during one frame period.

Because the third and seventh transistors T3 and T7 are NMOS transistors, the gate-on level of the control signal Cp supplied thereto may be a high voltage. Conversely, because the second, fourth, fifth and sixth transistors T2, T4, T5 and T6 are PMOS transistors, the gate-on level of the scan signal Sn and the emission control signals Ep and Ep-q supplied thereto may be a low voltage.

At the first time point t1, the previous emission control signal Ep-q is changed from a gate-on level to a gate-off level, and the sixth transistor T6 may be turned off. Because the fourth transistor T4 maintains a turn-on state, the voltage of the first power source VDD (or the reference power source Vref) may be supplied to the third node N3.

In addition, at the first time point t1, the control signal Cp is changed from a gate-off level to a gate-on level, and third and seventh transistors T3 and T7 may be turned on. In an exemplary embodiment of the present invention, the control signal Cp may maintain the gate-off level after the forth period P4. Accordingly, the third and seventh transistors T3 and T7 may maintain the turn-on state until the fourth period P4.

During the first period P1 from the first time point t1 to the second time point t2, the voltage of the initialization power source Vint may be supplied to the fourth node N4. In other words, the first period P1 may be the first initialization period for initializing the anode voltage of the light-emitting element LD.

According to an exemplary embodiment of the present invention, the control signal Cp may be changed to the gate-on level after the previous emission control signal Ep-q is changed from the gate-on level to the gate-off level. The time difference between the first time point t1 and the second time point t2 prevents the light-emitting element LD from incorrectly emit light when the seventh transistor T7 is turned on.

At the second time point t2, the previous emission control signal Ep-q may be changed from the gate-off level to the gate-on level, and the emission control signal Ep may be changed from the gate-on level to the gate-off level. At the second lime point t2, the fourth and fifth transistors T4 and T5 may be turned off, and the sixth transistor T6 may be turned on. Accordingly, the voltage of the initialization power source Vint may be supplied to the gate electrode of the first transistor T1 (in other words, the first node N1) through the third and sixth transistors T3 and T6.

During the second period P2 front the second time point t2 to the third time point t3, the previous emission control signal Ep-q may have a waveform opposite to that of the emission control signal Ep. For example, the previous emission control signal Ep-q may be low and the emission control signal Ep-q be high. Accordingly, the second period P2 may be the second initialization period for initializing the anode voltage of the light-emitting element LD and the gate voltage of the first transistor T1.

At the third time point t3, the previous emission control signal Ep-q may be changed from the gate-on level to the gate-off level, and the emission control signal Ep may be changed from the gate-off level to the gate-on level. Accordingly, the fourth and fifth transistors T4 and T5 may be turned on, and the sixth transistor T6 may be turned off. Because the third transistor T3 is in a turn-on state, the first transistor T1 may be diode-coupled. The second capacitor C2 may store the voltage corresponding to the threshold voltage Vth of the first transistor T1.

During the third period P3 from the third time point t3 to the fourth time point t4, the first transistor T1 is diode-coupled. Therefore, the threshold voltage of the first transistor T1 may be compensated. In other words, the third period P3 may be a threshold voltage compensation period.

In addition, in the third period P3, the threshold voltage of the first transistor T1 may be compensated by using the voltage of the first power source VDD, which is a constant-voltage source. Because the operation of compensating for the threshold voltage of the first transistor T1 is performed based on the fixed voltage, rather than a data signal (e.g., a data voltage), which may vary depending on the pixel row and/or frame, a change in the bias applied to the first transistor T1 is not large, and thus, the hysteresis of the first transistor T1 may be minimized.

As described above, in the second and third periods P2 and P3, the emission control signal Ep may have a waveform opposite to that of the previous emission control signal Ep-q.

At the fourth time point t4, the emission control signal Ep may be changed from the gate-on level to the gate-off level, and the fourth and fifth transistors T4 and T5 may be turned off. At the first time point t4, the emission control signal Ep may have the same level as the previous emission control signal Ep-q.

At the fifth time point t5, the n-th scan signal Sn may be changed from the gate-off level to the gate-on level, and the second transistor T2 of the n-th pixel PXn may be turned on. Accordingly, the data signal DATA may be supplied to the third node N3 of the n-th pixel PXn.

In addition, during the fourth period P4 from the fifth time point t5 to the sixth time point t6, the n-th scan signal Sn and the (n+1)-th scan signal Sn+1 may be sequentially supplied. Accordingly, the data signal DATA may be sequentially written to the n-th pixel PXn in response to the n-th scan signal Sn and the (n+1)-th pixel PXn+1 in response to the (n+1)-th scan signal Sn+1. Accordingly, the voltages corresponding to the threshold voltage Vth of the first transistor T1 and the data signal DATA may be stored in the first and second capacitors C1 and C2 of each of the n-th pixel PXn and the (n+1)-th pixel PXn+1 according to a charge-sharing principle. In other words, the fourth period P4 may be a data-writing period.

In an exemplary embodiment of the present invention, the pulse width of the scan signal Sn may be one horizontal period 1H. For example, as illustrated in FIG. 3A, the fourth period P4 may be equal to or greater than about two horizontal periods 2H. In addition, the pulse with of the (n+1)-th scan signal Sn+1 may be one horizontal period 1H.

After the fourth period P4, the previous emission control signal Ep-q may be changed to the gate-on level, and the control signal Cp may be changed to the gate-off level. Accordingly, the sixth transistor T6 may be turned on, and the third and seventh transistors T3 and T7 may be turned off.

Additionally, in FIG. 3A, the control signal Cp is illustrated as being changed to the gate-off level after the (n+1)-th scan signal Sn+1 is changed to the gate-off level, but the time at which the control signal Cp is changed to the gate-off level may be the same as the time at which the (n+1)-th scan signal Sn+1 is changed to the gate-off level.

At the seventh time point t7, the emission control signal Ep is changed from the gate-off level to the gate-on level, and the fourth and fifth transistors T4 and T5 may be turned on. Accordingly, the light-emitting element LD of each of the n-th and (n+1)-th pixels PXn and PXn+1 may emit light based on the voltage stored in the second capacitor C2. For example, the light-emitting element LD may emit light in response to the driving current based on Equation (1).

As described above, the pixel 10, e.g., either of PXn, and PXn+1, according to exemplary embodiments of the present invention may compensate for the threshold voltage of the first transistor T1 using the voltage of the first power source VDD, which is a constant-voltage source. Accordingly, the on-bias variation, which may be caused by a threshold voltage compensation operation using data signals, may be avoided. In addition, the operation (e.g., performed in the third period P3) for compensating for the threshold voltage of the first transistor T1 (in other words, a driving transistor) may be separate from the data-writing operation (in other words, performed the fourth period P4). Therefore, the threshold voltage compensation period P3 may be freely adjusted by adjusting the waveform of the emission control signal Ep. Therefore, sufficient time for compensating for the threshold voltage of a driving transistor may be secured in a display device in which high-speed driving is applied.

Accordingly, a demultiplexer used to supply a data signal in a high-speed driving technique, is omitted. Therefore, a dead space (e.g., a bezel) may be minimized and the manufacturing cost of the display device may be reduced. Furthermore, because some transistors may be implemented as NMOS transistors, which are robust to the current leakage, the pixel 10 according to exemplary embodiments of the present invention may also be applied to low-frequency driving.

In addition, the first capacitor C1 may be coupled to the second capacitor C2 through the drain electrode of the first transistor T1. Therefore, the effect of a decrease in the voltage of the first power source VDD and/or the voltage of a data signal on the driving current provided by the first transistor T1 may be reduced.

Therefore, the pixel 10 and the display device 1000 including the pixel 10 according to exemplary embodiments of the present invention may display an image in response to various driving frequencies, and the quality of the image may be increased.

FIG. 3B is a timing diagram for explaining an example of the operation of the pixel illustrated in FIG. 2A and FIG. 2B.

Because the operation of the pixel of FIG. 3B is the same as the operation of the pixel of FIG. 3A except for the timing of a control signal Cp, which is supplied to third and seventh transistors T3 and T7, the same reference numerals are used for the same or similar elements, and thus, a repeated description may be omitted.

Referring to FIG. 2A, FIG. 2B and FIG. 3B, an on-bias may be applied to the first transistor T1 in the first period P1'.

In the first period P1', the emission control signal Ep is applied and the previous emission control signal Ep-q and the control signal Cp are not supplied. Accordingly, the sixth transistor T6 may be turned off when the fourth and fifth transistors T4 and T5 are turned on. Here, a high voltage of five first power source VDD may be supplied to the first electrode (e.g., the drain electrode) of the first transistor T1. Accordingly, in the first period P1', the first transistor T1 may have an on-bias state.

In the second period P2, the anode voltage of the light-emitting element LD and the gate voltage of the first transistor T1 may be initialized.

The third period P3 is a threshold voltage compensation period, and the fourth period P4 is a data-writing period.

An on-bias is applied to the first transistor T1 in the first period P1', such that the hysteresis characteristic (in other words, the threshold voltage shift) of the first transistor T1 may be improved.

FIG. 3C is a timing diagram for explaining an example of the operation of the pixel illustrated in FIG. 2A and FIG. 2B.

Because the operation of the pixel of FIG. 3C is the same as the operation of the pixel of FIG. 3A except for the pulse width of each of the scan signals Sn and Sn+1, the same reference numerals are used for the same or similar elements, and thus, a repeated description may be omitted.

Referring to FIG. 2A, FIG. 2B, and FIG. 3C, the pulse width of a scan signal may be longer than one horizontal period 1H.

In an exemplary embodiment of the present invention, the pulse width of each of the n-th scan signal Sn and the (n+1)-th scan signal Sn+1 may be two horizontal periods 2H as illustrated in FIG. 3C, and the previous data signal and the current data signal may be sequentially supplied to the third node N3 of the pixel PXn and the third node N3 of the pixel PXn+1. Because the second transistor T2 is tinned off after the current data signal is supplied, the light-emitting element LD may emit light in response to the current data signal Dm.

In addition, in the state in which the n-th scan signal Sn maintains a gate-on level, the current data signal is supplied following the previous data signal. In this case, sufficient time for supplying the current data signal may be secured. For example, the fourth period P4' for writing data may be longer than the fourth period P4 of FIG. 3A and FIG. 3B.

Additionally, the (n+1)-th scan signal Sn+1 may partially overlap the n-th scan signal Sn. For example, when the pulse width of each of the scan signals Sn and Sn+1 is two horizontal periods 2H, the (n+1)-th scan signal Sn+1 and the n-th scan signal Sn may overlap during one horizontal period 1H of the two horizontal periods 2H. Accordingly, the light-emitting element LD of the (n+1)-th pixel PXn+1 may emit light in response to the data signal following the current data signal.

However, this is merely an example, and the pulse width of the scan signal may be three horizontal periods 3H, four horizontal periods 4H or more depending on a driving frequency and/or resolution.

In addition, periods during which a plurality of pixel rows adjacent to each other are driven may overlap in the fourth period P4. Therefore, the pixel 10 and the driving method thereof may be easily applied in a high-resolution display device 1000 and high-speed driving thereof.

Figure 4:
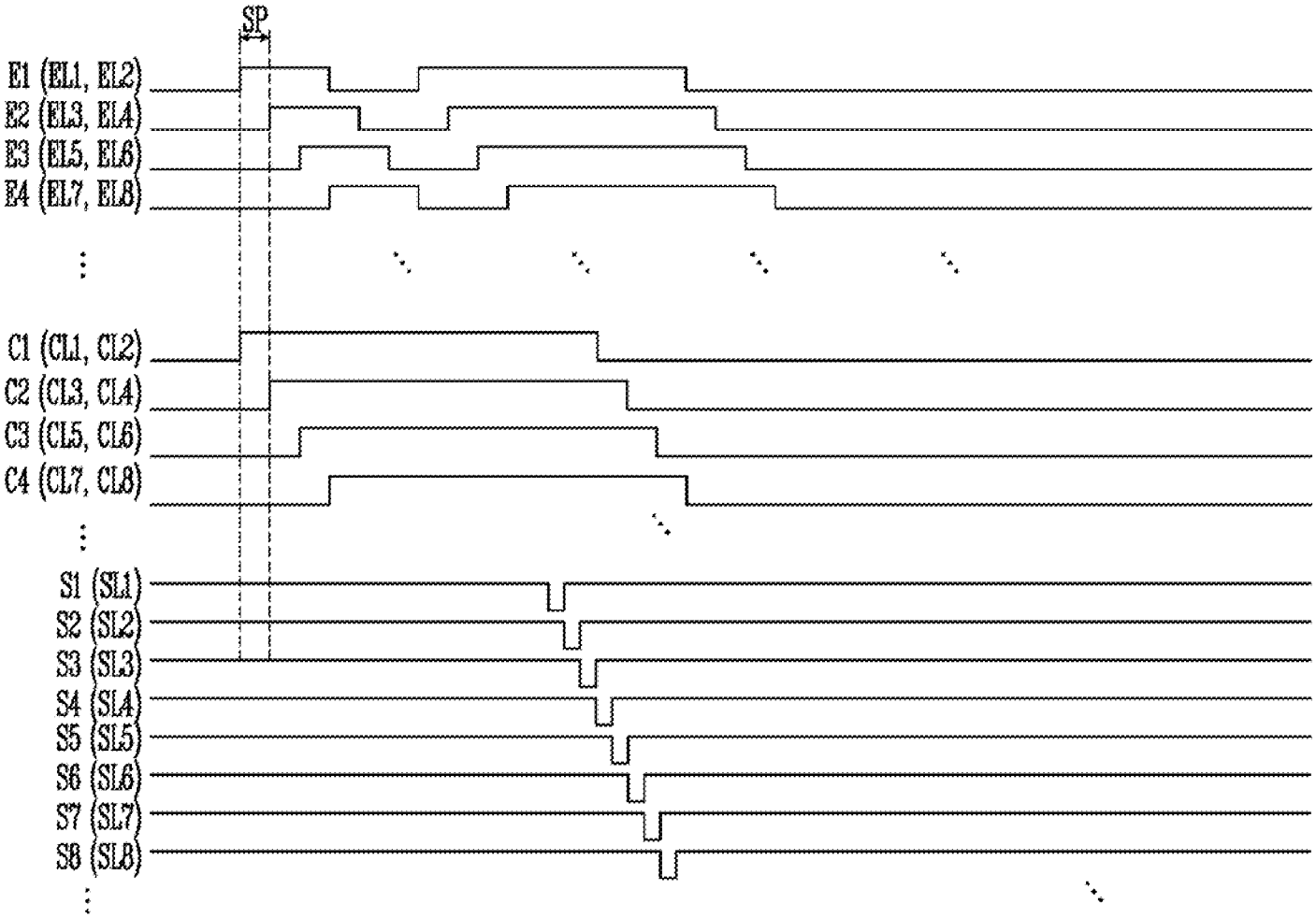
FIG. 4 is a timing diagram for explaining an example of the operation of the display device of FIG. 1.

FIG. 4 is a timing diagram for explaining an example of the operation of the display device of FIG. 1.

Referring to FIG. 1, FIG. 2B, FIG. 3A and FIG. 4, an emission control signal and a control signal may be supplied in common to every two pixel rows. In addition, each of the emission control signal and the control signal may be sequentially output at intervals of a predetermined shift period SP.

Additionally, the k-th signal line (e.g., an emission control line, a control line, or a scan line) for supplying the k-th signal (e.g., an emission control signal, a control signal, or a scan signal) may be understood as a signal line coupled to the pixels included in the k-th pixel row.

The first emission control signal E1 may be supplied in common to the First and second emission control lines EL1 and EL2. Similarly, the first control signal C1 may be supplied to the first and second control lines CL1 and CL2. Therefore, the shift period SP may be about two horizontal periods 2H. However, this is merely an example, and the shift period SP may be set to match the number of pixel rows to which an emission control signal (and a control signal) is (are) supplied in common. For example, when the first emission control signal E1 is supplied in common to the first to third emission control lines EL1, EL2 and EL3, the shift period SP may be about three horizontal periods 3H.

A scan signal (e.g., S1 to S8) may be sequentially supplied to the scan lines SL1 to SL8 at intervals of one horizontal period 1H. In other words, the shift period SP of each of the emission control signal and the control signal is longer than that of the scan signal.

Additionally, when the display device 1000 includes i pixel rows (where i is a natural number), the first scan driver 200 may output i scan signals, the second scan driver 300 may output i/2 control signals, and the emission driver 400 may output i/2 emission control signals. Accordingly, the power consumption of the display device 1000, which is driven at high speed, may be reduced.

Figure 5:
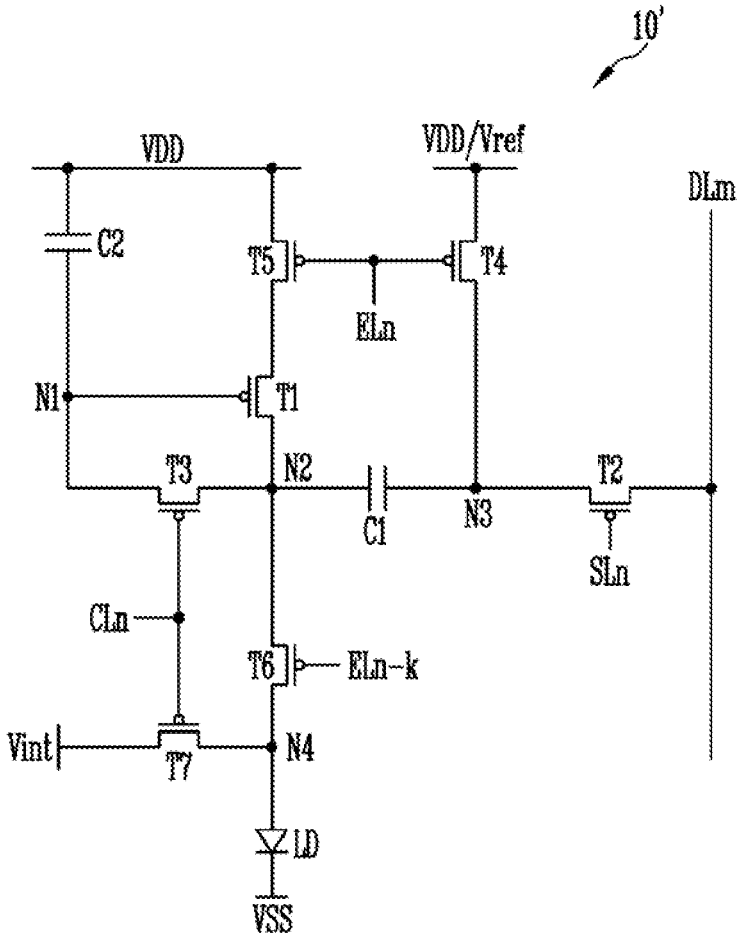
FIG. 5 is a circuit diagram illustrating an example of the pixel of FIG. 2A.

FIG. 5 is a circuit diagram that shows an example of the pixel of FIG. 2A.

Because the pixel of FIG. 5 has the same configuration and operation as the pixel of FIG. 2A except for the types of third and seventh transistors T3 and T7, the same reference numerals are used for the same or similar elements, and thus, a repeated description may be omitted.

Referring to FIG. 5, the pixel 10' may include a light-emitting element LD, first to seventh transistors T1 to T7, a first capacitor C1, and a second capacitor C2.

In an exemplary embodiment of the present invention, all of the first to seventh transistors T1 to T7 may be PMOS transistors. For example, the first, second, fourth, fifth and sixth transistors T1, T2, T4, T5 and T6 may be LTPS thin-film transistors.

Accordingly, a control signal may have a waveform that is opposite to that of the control signal Cp illustrated in FIGS. 3A to 3B. Because the pixel 10' in FIG. 5 has an active layer that is formed through an LTPS process, the manufacturing process may be simplified.

Figure 6:
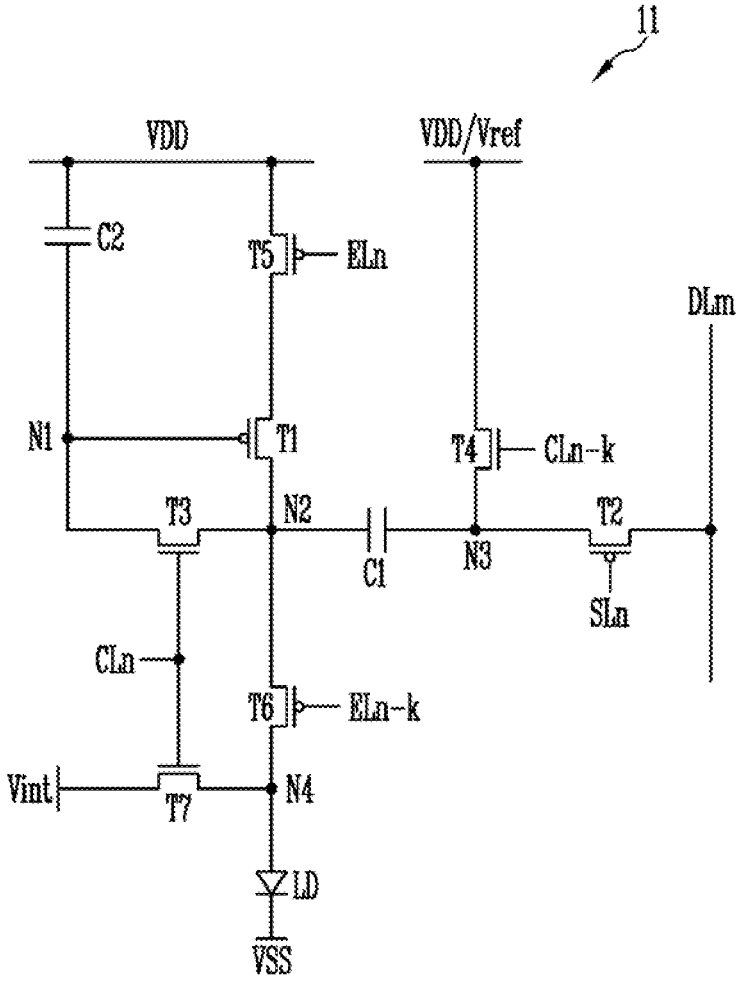
FIG. 6 is a circuit diagram illustrating an example of a pixel according to exemplary embodiments of the present invention.

FIG. 6 is a circuit diagram that shows an example of a pixel according to exemplary embodiments of the present invention.

Because the pixel of FIG. 6 has the same configuration and operation as the pixel of FIG. 2A except for the configuration of a fourth transistor T4, the same reference numerals are used for the same or similar elements, and thus, a repeated description will be omitted.

Referring to FIG. 6, the pixel 11 may include a light-emitting element LD, first to seventh transistors T1 to T7, a first capacitor C1, and a second capacitor C2.

In an exemplary embodiment of the present invention, the first, second, fifth and sixth transistors T1, T2, T5 and T6 may be PMOS transistors, and the third, fourth and seventh transistors T3, T4 and T7 may be NMOS transistors.

The gate electrode of the fourth transistor T4 may be coupled to the previous control line CLn-k, rather than the emission control line ELn. For example, the previous control line CLn-k may be the same as the control line coupled to the (n−k)-th pixel row. The second control signal supplied to the gate electrode of the fourth transistor T4 may be a signal shifted by k horizontal periods from the first control signal supplied to the gate electrode of the third transistor T3.

However, this is merely an example, and the second control signal supplied to the gate electrode of the fourth transistor T4 is not limited to the signal supplied to the previous control line CLn-k. For example, the fourth transistor T4 may be turned on by any control signal that is supplied earlier than the scan signal, which is supplied to the scan line SLn. Accordingly, before data is written, the fourth transistor T4 is turned on. In this case, the voltage of the third node N3 may be initialized to the voltage of the first power source VDD or the voltage of the reference power source Vref.

Additionally, the display device may further include an additional driving circuit (e.g., stages) configured to generate a second control signal and sequentially output the same in units of pixel rows.

Unlike the pixel 10 illustrated in FIG. 2A, the fourth transistor T4 of the pixel 11 may be turned off during an emission period P_E. In addition, the leakage current in the fourth transistor T4 may be reduced, and a low-frequency driving characteristic may be improved.

Figure 7A:
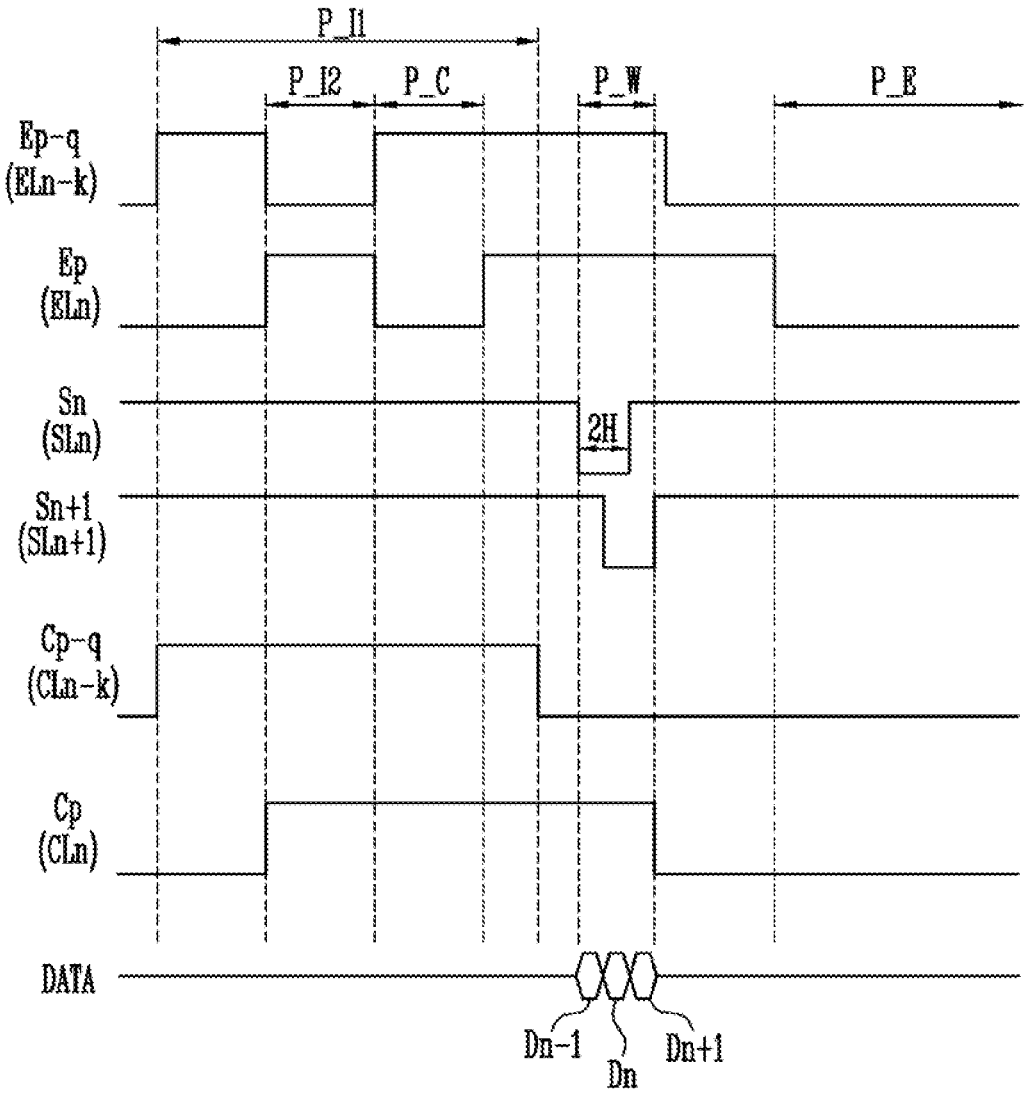
FIG. 7A is a timing diagram for explaining an example of the operation of the pixel of FIG. 6.

FIG. 7A is a timing diagram for explaining an example of the operation of the pixel of FIG. 6.

Because the operation of the pixel illustrated in FIG. 7A is the same as the operation of the pixel illustrated in FIG. 3A except for a previous control signal Cp-q supplied to a fourth transistor T4, the same reference numerals are used for the same or similar elements, and thus, a repeated description may be omitted.

Referring to FIG. 6 and FIG. 7A, one frame period may include a first initialization period P_I1, a second initialization period P_I2, a compensation period P_C, a data-writing period P_W, and an emission period P_E.

The previous control signal Cp-q (e.g., the second control signal) may be a signal shifted by k horizontal periods from the control signal Cp (e.g., the first control signal).

The period during which the previous control signal Cp-q has a gate-on level may be the first initialization period P_I1. In other words, in the first initialization period P_I1, the fourth transistor T4 is turned on. Therefore, the voltage of the first power source VDD (or the reference power source Vref) may be supplied to the third node N3.

During the second initialization period P_I2, the previous emission control signal Ep-q, the previous control signal Cp-q, and the control signal Cp may have a gate-on level. The second initialization period P_I2 may overlap the first initialization period P_I1. During the second initialization period P_I2, the emission control signal Ep and the scan signal Sn may have a gate-off level. Accordingly, during the second initialization period P_I2, live third, sixth and seventh transistors T3, T6 and T7 are turned on. Therefore, the anode voltage of the light-emitting element LD and the gate voltage of the first transistor T1 may be initialized by the voltage of the initialization power source Vint. In the second initialization period P_I2, both of the anode voltage of the light-emitting element and the gate voltage of the first transistor T1 may be initialized.

During the compensation period P_C, which is also overlapped by the first initialization period P_I1, the emission control signal Ep, the previous control signal Cp-q, and the control signal Cp may have a gate-on level. During the compensation period P_C, the previous emission control signal Ep-q and the scan signal Sn may have a gate-off level. Accordingly, during the compensation period P_C, the third, fourth and fifth transistors T3, T4 and T5 are turned on and the sixth transistor T6 is turned off. In this case, the threshold voltage of the first transistor T1 may be compensated for. The compensation period P_C may be adjusted depending on the duration of the gate-on period of the emission control signal Ep.

During the data-writing period P_W, the scan signal Sn and the control signal Cp may have a gate-on level. During the data-writing period P_W, the previous emission control signal Ep-q, the emission control signal Ep, and the previous control signal Cp-q may have a gate-off level. Accordingly, the second and third transistors T2 and T3 may be turned on, and the fourth, fifth and sixth transistors T4, T5 and T6 may be turned off. During the data-writing period P_W, the voltage of the data signal DATA may be stored in the pixel 11. For example, the voltage of the data signal DATA may be stored in the sequence of Dn−1, Dn and Dn+1.

During the emission period P_E, the previous emission control signal Ep-q and the emission control signal Ep may have a gate-on level. During the emission period P_E, the scan signal Sn, the previous control signal Cp-q, and the control signal Cp may have a gate-off level. During the emission period P_E, the fifth and sixth transistors T5 and T6 may be turned on and the second, third, fourth and seventh transistors T2, T3, T4 and T7 may be turned off. Accordingly, the light-emitting element LD may emit light in response to the current data signal Dn.

Figure 7B:
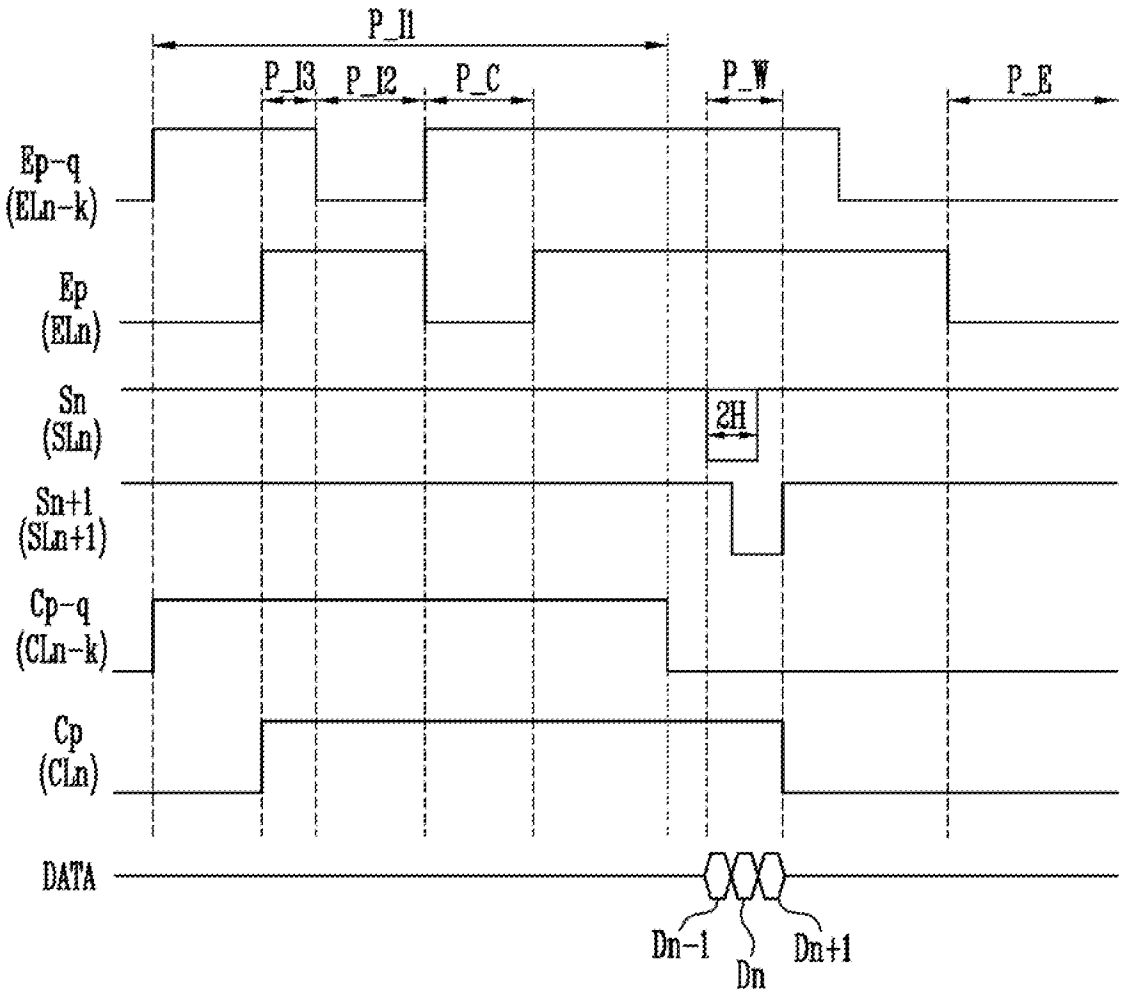
FIG. 7B is a timing diagram for explaining an example of the operation of the pixel of FIG. 6.

FIG. 7B is a timing diagram for explaining an example of the operation of the pixel illustrated in FIG. 6.

Because the operation of the pixel illustrated in FIG. 7B is the same as the operation of the pixel illustrated in FIG. 7A except for the operation in the third initialization period P_I3, the same reference numerals are used for the same or similar elements, and thus, a repeated description may be omitted.

Referring to FIG. 6 to FIG. 7B, one frame period may include a first initialization period P_I1, a second initialization period P_I2, a third initialization period P_I3, a compensation period P_C, a data-writing period P_W, and an emission period P_E.

In an exemplary embodiment of the present invention, before the second initialization period P_I2, the third initialization period P_I3 in which the gate-off period of the previous emission control signal Ep-q overlaps the gate-off period of the emission control signal Ep may be further included. Accordingly, in the third initialization period P_I3, the fifth and sixth transistors T5 and T6 are turned off, and the voltage of the initialization power source Vint may be supplied only to the fourth node N4.

In other words, in the third initialization period P_I3, only the anode voltage of the light-emitting element LD may be initialized.

Figure 8:
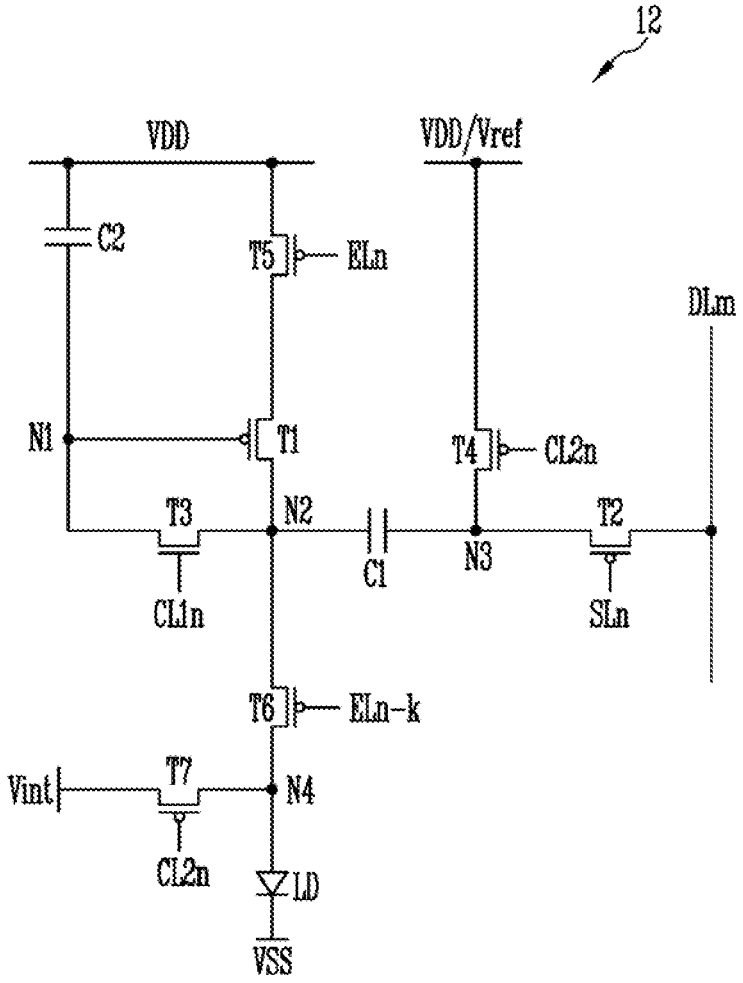
FIG. 8 is a circuit diagram illustrating a pixel according to exemplary embodiments of the present invention.

FIG. 8 is a circuit diagram that show's a pixel according to exemplary embodiments of the present invention.

Because the pixel illustrated in FIG. 8 has the same configuration and operation as the pixel illustrated in FIG. 2A except for the configuration of a seventh transistor T7 and a fourth transistor T4, the same reference numerals are used for the same or similar elements, and thus, a repeated description may be omitted.

Referring to FIG. 8, a pixel 12 may include a light-emitting element LD, first to seventh transistors T1 to T7, a first capacitor C1, and a second capacitor C2.

In an exemplary embodiment of the present invention, the first, second, fourth, fifth, sixth and seventh transistors T1, T2, T4. T5. T6 and T7 may be PMOS transistors, and the third transistor T3 may be an NMOS transistor.

The gate electrode of the third transistor T3 may be coupled to a first control line CL1*n*. The third transistor T3 may be turned on in response to the first control signal supplied to the first control line CL1*n*.

The gate electrodes of the fourth transistor T4 and the seventh transistor T7 may be coupled to a second control line CL2*n* for supplying the same second control signal.

When only the third transistor T3 is an NMOS transistor, semiconductor layers that form the respective active patterns of the other transistors, excluding the third transistor T3, may form a single body. Therefore, the pixel 12 illustrated in FIG. 8 may be manufactured through a simpler process than the process for manufacturing the pixel 10 or 11 illustrated in FIG. 2A or FIG. 6.

Figure 9:
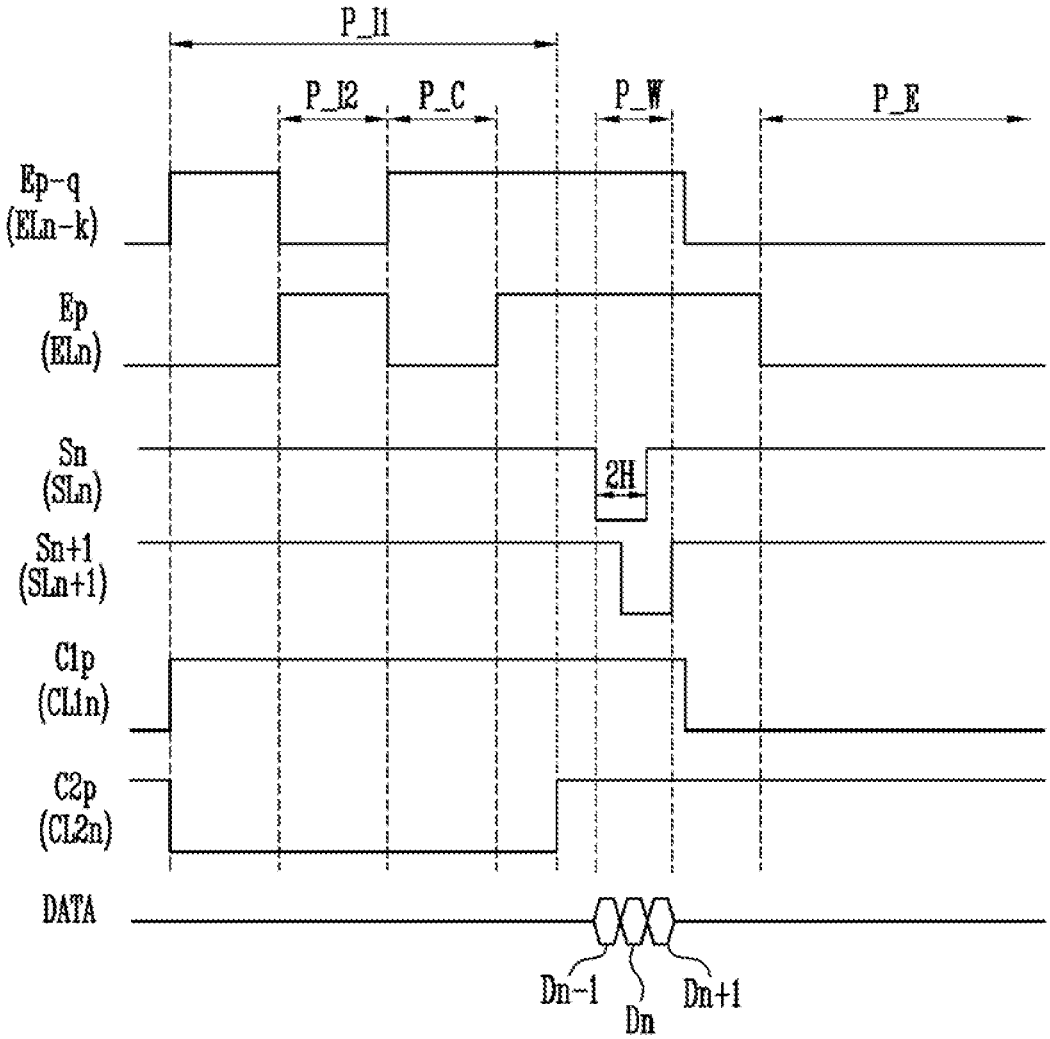
FIG. 9 is a timing diagram for explaining an example of the operation of the pixel of FIG. 8.

FIG. 9 is a timing diagram for explaining an example of the operation of the pixel illustrated in FIG. 8.

Because the operation of the pixel illustrated in FIG. 9 is the same as the operation of the pixel illustrated in FIG. 3C except for the second control signal C2*p* supplied to fourth and seventh transistors T4 and T7, the same reference numerals are used for the same or similar elements, and thus, a repeated description may be omitted.

Referring to FIG. 8 and FIG. 9, one frame period may include a first initialization period P_I1, a second initialization period P_I2, a compensation period P_C, a data-writing period P_W, and an emission period P_E.

In an exemplary embodiment of the present invention, the gate-on level of the second control signal C2*p* supplied to a second control line CL2*n* may be a low voltage, and the gate-on level of the first control signal C1*p* supplied to a first control line CL1*n* may be a high voltage.

The period during which the second control signal C2*p* has a gate-on level may be the first initialization period P_I1. In other words, in the first initialization period P_I1, the fourth transistor T4 is turned on. In this case, the voltage of the first power source VDD may be supplied to the third node N3.

During the second initialization period P_I2, the anode voltage of the light-emitting element LD and the gate voltage of the first transistor T1 may be initialized.

During the compensation period P_C, the threshold voltage of the first transistor T1 may be compensated for. Subsequently, during the data-writing period P_W, the voltage of the current data signal Dn may be stored in the n-th pixel, and the voltage of the next data signal Dn+1 may be stored in the (n+1)-th pixel. During the emission period P_E, the fifth and sixth transistors T5 and T6 are turned on, so that the light-emitting element LD may emit light.

As described above, the compensation period P_C during which the threshold voltage is compensated for may be separate from the data-writing period P_W during which the data signal DATA is written. Accordingly, the sufficient compensation period P_C may be secured, and a demultiplexer for the supply of a data signal, which is used for high-speed driving, may be omitted.

Figure 10:
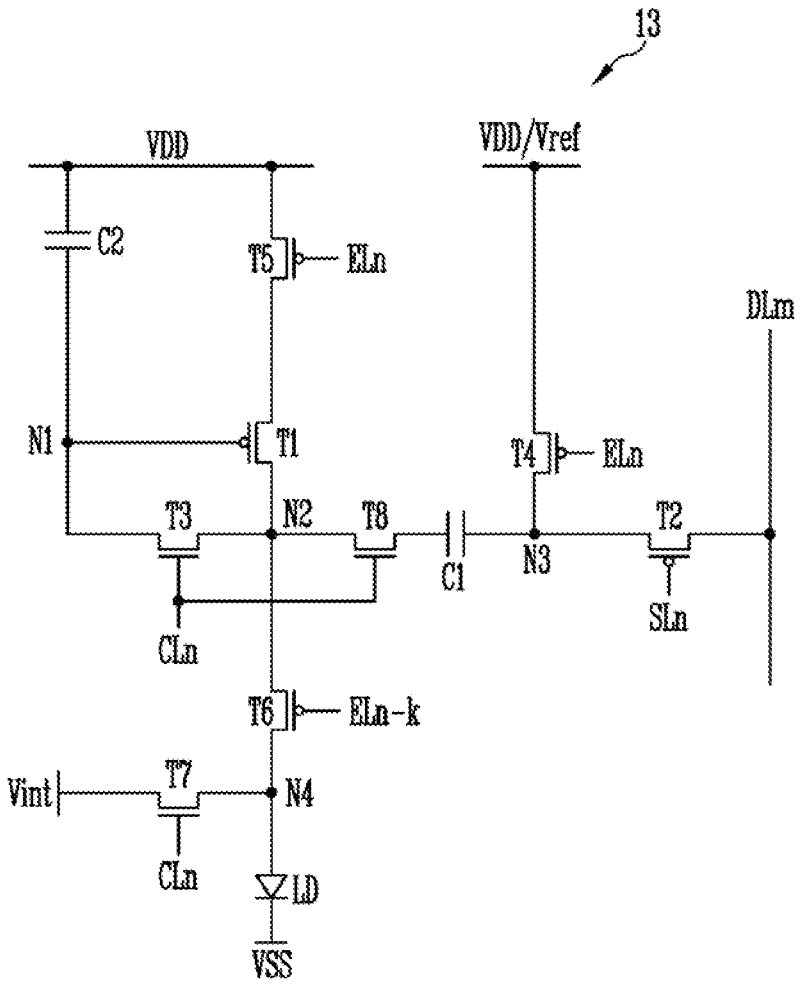
FIG. 10 is a circuit diagram illustrating an example of the pixel of FIG. 2A.

FIG. 10 is a circuit diagram that shows an example of the pixel of FIG. 2A.

Because the pixel illustrated in FIG. 10 has the same configuration and operation as the pixel illustrated in FIGS. 2A to 3C except for the configuration of an eighth transistor, the same reference numerals are used for the same or similar elements, and thus, a repeated description may be omitted.

Referring to FIG. 10, a pixel 13 may include a light-emitting element LD, first to eighth transistors T1 to T8, a first capacitor C1, and a second capacitor C2.

The eighth transistor T8 may be coupled between a second node N2 and the first capacitor C1. The gate electrode of the eighth transistor 18 may be coupled to a control line CLn. In other words, the gate electrode of the eighth transistor T8 and the gate electrode of the third transistor T3 may be coupled to the control line CLn.

In an exemplary embodiment of the present invention, the eighth transistor T8 may be the same type as the third transistor T3. For example, both of the third and eighth transistors T3 and T8 may be NMOS transistors.

As illustrated in FIG. 3A, the control signal Cp supplied to the control line CLn may have a gate-on level during the first to fourth periods P1 to P4.

The eight transistor T8 may be turned off in a period between the fourth period P4 and the fifth period P5, and may maintain the turn-off state during the fifth period P5, which is an emission period. In other words, the eighth transistor T8 may prevent the second node N2 from being electrically coupled to the first capacitor C1 before emission after the data signal DATA is written.

However, this is merely an example, and the eighth transistor T8 can only be turned off after the fourth period P4, in other words, the data-writing period. Accordingly, the control signal supplied to the gate electrode of the eighth transistor T8 is not limited to the control signal Cp.

During the fifth period P5, an electric coupling between the drain electrode of the first transistor T1 and the first capacitor C1 may be blocked. Accordingly, an unintended variation in the voltage of the second node N2 by the first capacitor C1 may be prevented during the emission period, and the light-emitting element LD may emit light more stably.

Figure 11:
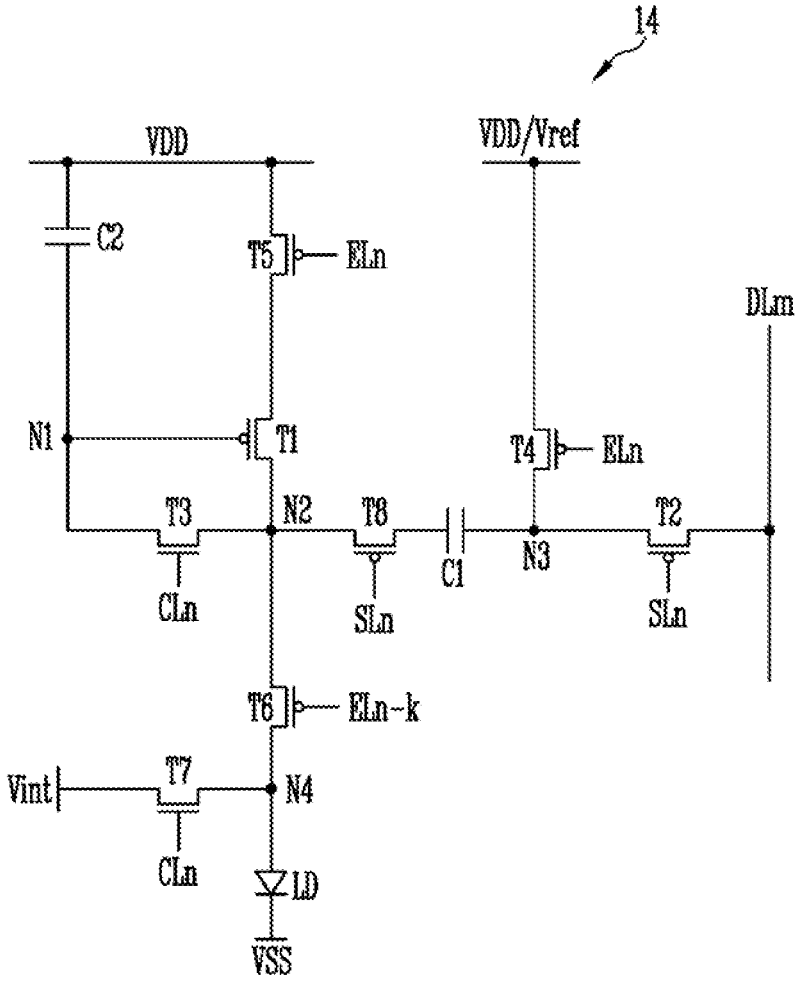
FIG. 11 is a circuit diagram illustrating an example of the pixel of FIG. 2A.

FIG. 11 is a circuit diagram that shows an example of the pixel of FIG. 2A.

Because the pixel illustrated in FIG. 11 has the same configuration and operation as the pixel illustrated in FIG. 10 except for the configuration of the gate electrode of an eighth transistor, the same reference numerals are used for the same or similar elements, and thus, a repeated description may be omitted.

Referring to FIG. 11, a pixel 14 may include a light-emitting element LD, first to eighth transistors T1 to T8, a first capacitor C1, and a second capacitor C2.

The eighth transistor T8 may be coupled between the second node N2 and the first capacitor C1. The gate electrode of the eighth transistor T8 may be coupled to a scan line SLn. In other words, the gate electrode of the eighth transistor T8 may be coupled to the scan line SLn to which the gate electrode of the second transistor T2 is also coupled.

In an exemplary embodiment of the present invention, the eighth transistor T8 may be a different type from the third transistor T3. For example, the eighth transistor T8 may a PMOS transistor, which is of the same type as the second transistor T2.

The eighth transistor T8 is turned on in the fourth period P4, which is a data-writing period, thereby transmitting a data signal to the second node N2. The eighth transistor T8 may prevent the second node N2 from being electrically coupled to the first capacitor C1 before emission after the data signal is written. Accordingly, an unintended variation in the voltage of the second node N2 by the first capacitor C1 may be prevented during the emission period, and the light-emitting element LD may emit light more stably.

A pixel and a display device including the same according to exemplary embodiments of the present invention may compensate for a threshold voltage using the voltage of a first power source, which is a constant-voltage source. Accordingly, it is possible to improve and remove display defects, such as motion blur caused by an on-bias variation resulting from an existing threshold voltage compensation operation using a data signal (and a hysteresis characteristic causing the shift in the threshold voltage).

In addition, the operation for compensating for the threshold voltage of a first transistor (in other words, a driving transistor) may be separate from a data-writing operation, and a threshold voltage compensation period may be freely adjusted by adjusting the waveform of an emission control signal. Therefore, it is possible to secure sufficient time to compensate for the threshold voltage in a display device in which high-speed driving is applied. In addition, a demultiplexer for the supply of a data signal, which is required for high-speed driving, is omitted. Therefore, a dead space (e.g., a bezel) may be minimized and the manufacturing cost of the display device may be reduced.

Furthermore, because some transistors are implemented as NMOS transistors, which are robust to current leakage, the pixel and the display device including the same may be easily applied even when the display device is driven at a low frequency.

While the present invention has been described with reference to exemplary embodiments thereof, those skilled in the art will appreciate that various changes in form and details may be made thereto without departing from the spirit and scope of the present invention as set forth in the following claims.

What is claimed is:

1. A pixel, comprising:

a light-emitting element;

a first transistor configured to control a driving current, the first transistor including a first electrode electrically coupled to a first power source and a second electrode electrically coupled to the light-emitting element;

a first capacitor directly connected to a second node and a third node, wherein the second node is directly connected to the second electrode of the first transistor, the second electrode of the first transistor being a source or a drain of the first transistor;

a second transistor coupled between the third node and a data line and configured to be turned on in response to a scan signal;

a third transistor coupled between a first node and the second node and configured to be turned on in response to a first control signal, wherein the first node is connected to a gate electrode of the first transistor;

a fourth transistor coupled between the first power source and the third node and configured to be turned on in response to a second control signal;

a fifth transistor coupled between the first power source and the first electrode of the first transistor and configured to be turned on in response to an emission control signal;

a sixth transistor coupled between the second node and the light-emitting element and configured to be turned on in response to a previous emission control signal; and a second capacitor coupled between the first power source and the first node.

2. The pixel according to claim 1, further comprising:

a seventh transistor coupled between the light-emitting element and an initialization power source and configured to be turned on in response to a third control signal.

3. The pixel according to claim 2, wherein the first transistor, the second transistor, the fourth transistor, the fifth transistor and the sixth transistor are P-channel metal oxide semiconductor (PMOS) transistors, and the third transistor and the seventh transistor are N-channel metal oxide semiconductor (NMOS) transistors.

4. The pixel according to claim 3, wherein the first control signal and the third control signal are identical signals supplied through an identical control line.

5. The pixel according to claim 4, wherein the second control signal is identical to the emission control signal.

6. The pixel according to claim 3, wherein a voltage of the initialization power source is supplied to the light-emitting element in a first period, the voltage of the initialization power source is supplied to the first node in a second period, the first transistor is diode-coupled based on a voltage of the first power source in a third period, and the second transistor is turned on such that a data signal is supplied to the third node through the data line in a fourth period.

7. The pixel according to claim 6, wherein the third transistor maintains a turn-on state during the first, second, third and fourth periods in response to the first control signal.

8. The pixel according to claim 6, wherein:

in the first period and the third period, the fifth transistor is turned on and the sixth transistor is turned off; and in the second period, the fifth transistor is turned off and the sixth transistor is turned on.

9. The pixel according to claim 6, wherein the emission control signal is shifted by k horizontal periods from the previous emission control signal, where k is an integer greater than or equal to 3.

10. The pixel according to claim 6, wherein:

in the first period, the sixth transistor is turned off; and in the second period, the third transistor, the sixth transistor, and the seventh transistor are turned on.

11. The pixel according to claim 2, wherein the first transistor, the second transistor, the fifth transistor, and the sixth transistor are P-channel metal oxide semiconductor (PMOS) transistors, and the third transistor, the fourth transistor, and the seventh transistor are N-channel metal oxide semiconductor (NMOS) transistors.

12. The pixel according to claim 11, wherein: the first control signal and the third control signal are identical signals supplied through an identical control line, and the second control signal is shifted by k horizontal periods from the first control signal, where k is an integer greater than or equal to 3.

13. The pixel according to claim 11, wherein the emission control signal is shined by k horizontal periods from the previous emission control signal, where k is an integer greater than or equal to 3.

14. The pixel according to claim 2, wherein the first transistor, the second transistor, the fourth transistor, the fifth transistor, the sixth transistor and the seventh transistor are P-channel metal oxide semiconductor (PMOS) transistors, and the third transistor is an N-channel metal oxide semiconductor (NMOS) transistor.

15. The pixel according to claim 14, wherein the second control signal and the third control signal are identical signals supplied through an identical control line.

16. A pixel, comprising:

a light-emitting element;

a first transistor configured to control a driving current, the first transistor including a first electrode electrically coupled to a first power source and a second electrode electrically coupled to the light-emitting element;

a first capacitor coupled between a second node and a third node, wherein the second node is connected to the second electrode of the first transistor;

a second transistor coupled between the third node and a data line and configured to be turned on in response to a scan signal;

a third transistor coupled between a first node and the second node and configured to be turned on in response to a first control signal, wherein the first node is connected to a gate electrode of the first transistor;

a fourth transistor coupled between the first power source and the third node and configured to be turned on in response to a second control signal;

a fifth transistor coupled between the first power source and the first electrode of the first transistor and configured to be turned on in response to an emission control signal;

a sixth transistor coupled between the second node and the light-emitting element and configured to be turned on in response to a previous emission control signal; and a second capacitor coupled between the first power source and the first node, wherein, when the third transistor and the fourth transistor are turned on, the second transistor and the sixth transistor are turned off.

17. A pixel, comprising:

a light-emitting element;

a first transistor configured to control a driving current, the first transistor including a first electrode electrically coupled to a first power source and a second electrode electrically coupled to the light-emitting element;

a first capacitor coupled between a second node and a third node, wherein the second node is connected to the second electrode of the first transistor;

a second transistor coupled between the third node and a data line and configured to be turned on in response to a scan signal;

a third transistor coupled between a first node and the second node and configured to be turned on in response to a first control signal, wherein the first node is connected to a gate electrode of the first transistor;

a fourth transistor coupled between the first power source and the third node and configured to be turned on in response to a second control signal;

a fifth transistor coupled between the first power source and the first electrode of the first transistor and configured to be turned on in response to an emission control signal;

a sixth transistor coupled between the second node and the light-emitting element and configured to be turned on in response to a previous emission control signal;

a second capacitor coupled between the first power source and the first node;

a seventh transistor coupled between the light-emitting element and an initialization power source and configured to be turned on in response to a third control signal; and an eighth transistor coupled between the second node and the first capacitor and configured to be turned on in response to the first control signal or the scan signal.

18. A display device, comprising:

a display panel including a plurality of pixels;

a first scan driver configured to supply a scan signal to the pixels through a plurality of scan lines;

a second scan driver configured to supply a control signal to the pixels through a plurality of control lines;

an emission driver configured to supply an emission control signal to the pixels through a plurality of emission control lines; and a data driver configured to supply a data voltage to the display panel through a plurality of data lines, wherein at least one of the pixels comprises:

a light-emitting element;

a first transistor configured to control a driving current, the first transistor including a first electrode electrically coupled to a first power source and a second electrode electrically coupled to the light-emitting element;

a first capacitor coupled between a second node and a third node, wherein the second node is connected to the second electrode of the first transistor;

a second transistor coupled between the third node and the data line and configured to be turned on by the scan signal;

a third transistor coupled between a first node and the second node and configured to be turned on by the control signal, wherein the first node is connected to a gate electrode of the first transistor;

a fourth transistor coupled between the first power source and the third node and configured to be turned on by the emission control signal;

a fifth transistor coupled between the first power source and the first electrode of the first transistor and configured to be turned on by the emission control signal;

a sixth transistor coupled between the second node and the light-emitting element and configured to be turned on by a previous emission control signal;

a second capacitor coupled between the first power source and the first node; and a seventh transistor coupled between the light-emitting element and an initialization power source and configured to be turned on by the control signal.

19. A pixel, comprising:

a light-emitting element;

a first transistor including, a first electrode electrically coupled to a first power source and a second electrode electrically coupled to the light-emitting element;

a second transistor coupled to a data line and configured to be turned on by a scan signal;

a first capacitor coupled between the second electrode of the first transistor and the second transistor;

a third transistor coupled between a gate electrode of the first transistor and the first capacitor and configured to be turned on by a first control signal;

a fourth transistor coupled between the first power source and the first capacitor;

a fifth transistor coupled between the first power source and the first electrode of the first transistor and configured to be turned on in response to an emission control signal, wherein a gate electrode of the fifth transistor is connected to a gate electrode of the fourth transistor;

a sixth transistor coupled between the first capacitor and the light-emitting element and configured to be turned on by a previous emission control signal; and a second capacitor coupled between the first power source and the gate electrode of the first transistor.

* * * * *